US012655559B2

(12) United States Patent
Lovelady et al.

(10) Patent No.: US 12,655,559 B2
(45) Date of Patent: Jun. 16, 2026

(54) SELECTABLE GAUGE TUFTING MACHINE

(71) Applicant: Card-Monroe Corp., Chattanooga, TN (US)

(72) Inventors: Brian Lovelady, Soddy Daisy, TN (US); Ricky E. Mathews, Sale Creek, TN (US)

(73) Assignee: Card-Monroe, Corp., Chattanooga, TN (US)

( * ) Notice: Subject to any disclaimer, the term of this patent is extended or adjusted under 35 U.S.C. 154(b) by 0 days.

(21) Appl. No.: 19/003,471

(22) Filed: Dec. 27, 2024

(65) Prior Publication Data

US 2026/0049424 A1 Feb. 19, 2026

Related U.S. Application Data

(60) Provisional application No. 63/615,999, filed on Dec. 29, 2023.

(51) Int. Cl.

| | |
|---|---|
| ***D05C 15/10*** | (2006.01) |
| ***D05C 15/14*** | (2006.01) |
| ***D05C 15/30*** | (2006.01) |
| ***D05C 15/34*** | (2006.01) |

(52) U.S. Cl.

CPC ..... *D05C 15/10* (2013.01); *D05C 15/14* (2013.01); *D05C 15/30* (2013.01); *D05C 15/34* (2013.01)

(58) Field of Classification Search

CPC ..... D05C 15/04; D05C 15/06; D05C 15/08; D05C 15/10; D05C 15/12; D05C 15/14; D05C 15/16; D05C 15/20; D05C 15/26; D05C 15/28; D05C 15/30; D05C 15/34

See application file for complete search history.

(56) References Cited

U.S. PATENT DOCUMENTS

| | | | |
|---|---|---|---|
| 2,850,994 | A | 9/1958 | Crawford |
| 5,392,723 | A | 2/1995 | Kaju |
| 5,505,150 | A | 4/1996 | James et al. |
| 5,979,344 | A | 11/1999 | Christman, Jr. |
| 7,634,326 | B2 | 12/2009 | Christman, Jr. et al. |
| 7,717,051 | B1 | 5/2010 | Hall et al. |
| 7,814,850 | B2 | 10/2010 | Bearden |
| 9,290,874 | B2 | 3/2016 | Mathews et al. |
| 10,190,246 | B2 | 1/2019 | Neely et al. |
| 10,767,294 | B2 | 9/2020 | Vaughan et al. |
| 11,072,876 | B2 | 7/2021 | Hall et al. |
| 11,214,905 | B2 | 1/2022 | Hall et al. |
| 11,214,921 | B2 | 1/2022 | Hall |
| 11,505,886 | B2 | 11/2022 | Padgett et al. |

(Continued)

*Primary Examiner* — Khoa D Huynh
*Assistant Examiner* — Erick I Lopez
(74) *Attorney, Agent, or Firm* — Adams & Reese LLP; D. Scott Sudderth

(57) ABSTRACT

A system and method for forming patterned tufted articles, including controlling placement of yarns at each of a series of stitch locations of the pattern being tufted, and with the needles and corresponding gauge parts of the tufting machine being enabled to be shifted in multiple, varying shift increments, including in increments that are multiples of a gauge spacing of the needles, and in non-uniform shift increments not tied to the gauge of the needles, to form varying gauge tufted patterns, including finer gauge patterns, and which can be formed using a substantially same or consistent tufting machine gauge set-up.

20 Claims, 17 Drawing Sheets

(56) References Cited

U.S. PATENT DOCUMENTS

| | | | | |
|---|---|---|---|---|
| 11,618,985 | B2 | 4/2023 | Detty et al. | |
| 11,661,694 | B2 | 5/2023 | Detty et al. | |
| 11,686,027 | B2 | 6/2023 | Detty et al. | |
| 11,725,320 | B2 | 8/2023 | Hall | |
| 11,802,359 | B2 | 10/2023 | Beatty | |
| 11,873,592 | B2 | 1/2024 | Mathews | |
| 12,037,727 | B2 | 7/2024 | Padgett | |
| 12,173,439 | B2 | 12/2024 | Hall et al. | |
| 12,180,632 | B2 | 12/2024 | Mathews et al. | |
| 12,203,200 | B2 | 1/2025 | Detty et al. | |
| 2007/0272138 | A1* | 11/2007 | Johnston | D05C 15/22 112/80.01 |
| 2013/0180440 | A1* | 7/2013 | Hall | D05C 15/16 112/80.32 |
| 2022/0325457 | A1* | 10/2022 | Callens | D05C 15/10 |
| 2024/0003101 | A1* | 1/2024 | Stephen | D01F 6/04 |

* cited by examiner

SELECTABLE GAUGE TUFTING MACHINE

CROSS REFERENCE

The present Patent Application claims the benefit of U.S. Provisional Patent Application No. 63/615,999, filed Dec. 29, 2023.

INCORPORATED BY REFERENCE

The disclosure and figures of U.S. Provisional Patent Application No. 63/615,999, filed Dec. 29, 2023 are specifically incorporated by reference herein as if set forth in its entirety.

TECHNICAL FIELD

The present disclosure generally relates to tufting systems and methods of tufting, and in particular, to tufting machinery, systems, apparatus, and methods for forming tufted articles having multiple different sewing gauges with enhanced resolution and various selectable densities.

BACKGROUND

In the tufting field, considerable emphasis has been placed on developing new, more intricate carpet patterns, including patterns with multiple colors, images, and designs, to keep up with changing consumer tastes and increased competition in the marketplace. As demands for greater patterning capabilities continue to grow, designers have looked to machine manufacturers to develop new tufting machines and systems that can enable tufting of increasingly complex carpet pattern designs to meet increasing customer demands. Systems have been developed for the production of more complex, multi-color patterns, but these patterns still are generally restricted to patterns based on gauge of the tufting machine. Another difficulty has been producing complex patterns with a high level of clarity, particularly when running the tufting machines at high production rates.

Accordingly, it can be seen that needs exist for tufting machines and yarn feed systems that address these and other related and unrelated problems in the art.

SUMMARY

Briefly described, the present disclosure generally relates to tufting machines and systems for production of tufted articles, including, without limitation, carpets, rugs, artificial grass or turf, and other tufted products; and to patterning systems and/or components for formation of patterned tufted articles including tufted articles having a plurality of colors, types of yarns, pile heights, sculptured looks, and/or other pattern effects.

According to one aspect of the present disclosure, a tufting machine and method of tufting are provided to enable formation of patterned tufted articles, wherein the tufted fabrics can be selectively formed with a variety of different selected gauges not limited to the gauge of the needle bar/tufting machine) (e.g., a gauge spacing between the needles of a needle bar(s) of a tufting machine. In embodiments, the tufting machine and method of tufting, can include the formation of patterned tufted articles with variable selected densities, including forming patterns with increased resultant/sewn or finished densities of tufts of yarns to provide greater resolution and accuracy of tufted patterns using the tufting machine without being limited by the gauge of the tufting machine, and/or without having to change or vary the gauge of the needles to form such different gauge density tufted articles.

In embodiments, the tufting machine can comprise a frame, a backing or cloth feed, a yarn feed, puller rolls, at least one needle bar having a series of needles arranged at a first spacing (e.g., a selected pitch or needle gauge spacing, such as, without limitation, $1/8^{th}$ inch, $1/10^{th}$ inch, $1/12^{th}$ inch, etc., and which, in embodiments, can comprise a spacing based on a gauge of the needle bar and/or the tufting machine), a gauge part assembly including at least one gauge bar having series of gauge parts arranged therealong at a second spacing; and at least one shift mechanism configured to shift the needle bar and gauge bar. In embodiments, the second spacing of the gauge parts can substantially match the first spacing of the needles (e.g. matching the gauge spacing or pitch of the needles along the needle bar); and in embodiments, the at least one shift mechanism can shift the at least one needle bar and at least one gauge bar in a substantially matched pitch relationship such that the needles and corresponding ones of the gauge parts remain substantially aligned as they are shifted transversely with respect to the backing.

In embodiments, the one or more shift mechanisms can be controlled to shift both the needles and corresponding gauge parts in shift steps based upon the gauge spacing of the needles, or at multiples thereof, which can include shifting both axes (e.g., an axis along which the needles are arranged and an axis along which the gauge parts are arranged) in substantially standard increments or multiples thereof (e.g., in single or double gauge shift distances or increments). For example, and not limitation, using a tufting machine having at least one $1/10^{th}$ gauge needle bar and gauge bar, (e.g., with the first spacing of the needles and the second spacing of the gauge parts arranged along the needle bar and gauge bar, respectively, substantially matching at a gauge spacing of about $1/10^{th}$ inch), both the needle bar and gauge bar can be indexed in a substantially synchronous movement in increments generally matching the gauge spacing (e.g., 0.10 inch), or, in embodiments, can be moved in other selected increments based on multiples of the gauge spacing (e.g., moving 0.050 inches to from $1/20^{th}$ gauge tufted articles, 0.025 inches to form $1/40^{th}$ gauge tufted articles, etc.). Other gauge spacings and shift increments or steps also can be used.

In addition, in some embodiments, the needles and gauge parts further can be shifted in increments that are not based on the gauge spacing of the needles. Again using the example of a $1/10^{th}$ gauge tufting machine with a $1/10^{th}$ gauge needle bar having needles arranged on gauge at a spacing of $1/10^{th}$ inch (0.10 inch) and a $1/10^{th}$ gauge bar having corresponding gauge parts arranged on gauge at a spacing of $1/10^{th}$ inch (0.10 inch), in embodiments, the one or more shift mechanisms can be controlled to shift the at least one needle bar and the at least one gauge bar together at increments or distances based on a multiple or fraction of the gauge of the tufting machine/needle bar; while in other embodiments, the needle bar and gauge bar can be indexed so as to shift the needles and their corresponding gauge parts at non-uniform or non-standard pitch or gauge increments e.g., for shifting the needles and gauge parts in increments that are not based on a multiple or fraction of the gauge of the tufting machine. For example, in embodiments, while the needles and gauge parts are arranged at a gauge spacing of $1/10^{th}$ inch, the needles and gauge parts could be shifted about 0.090 inches, to form approximately an $1/11^{th}$ gauge tufted article, or at various other distances, to form a pattern with a variable spacing of tufts.

Still further, in some embodiments, the needles and gauge parts can be shifted in single or double shift gauge steps. In some embodiments, the needles can be shifted separately from the gauge parts, including being shifted in different increments from the gauge parts. In other embodiments, the needles can be shifted while the gauge parts can be maintained in substantially the same locations.

In embodiments, the tufting machine of the present disclosure can further include a control system for controlling the operative elements of the tufting machine (e.g., a main drive of the tufting machine, the backing or cloth feed, yarn feed puller rolls, the one or more shift mechanisms, etc.) to form desired inputs, such as programmed, scanned, stored, and/or designed patterns. Such patterns can include various pattern effects, including having multiple selectable gauges, varied or different pile heights, cut and/or loop pile tufts, varying tuft rows, and/or other textured effects, as well as the placement of selected colors and/or types yarns to be visible at selected stitch or tuft locations along and across the backing. The resultant tufted article can be provided with a selected density of retained and/or visible colors/stitches per inch that can be increased over a designed density of the pattern being produced to provide enhanced clarity of the pattern. In embodiments, the resultant tufted pattern of retained or visible tufts of yarns can substantially match a desired or prescribed pattern density or stitches per inch for the pattern being formed/tufted.

In embodiments, the density of the resultant pattern can be based on the gauge of the needles (e.g., the spacing between the needles), and further can be selectively varied (e.g., increased based on shifting of the needle bar and gauge bar at various selected increments that are less than or greater than the gauge spacing of the needles). For example, in some embodiments, at least a portion of the needles and corresponding gauge parts can be indexed or shifted transversely with respect to the backing in various increments that are based on a multiple or fraction of the gauge of the needles/tufting machine; or, in embodiments, at least a portion of the needles and corresponding gauge parts can be selectively indexed or shifted by a non-uniform or non-standard distance or increment not based on a multiple or fraction of the gauge. Also, in embodiments, at least a portion of the needles can be shifted at increments based on one or more multiples or fractions of the gauge spacing of the needles, or at non-uniform pitch/gauge increments while the gauge parts can be maintained in a substantially same location.

In addition, in embodiments, the needles and gauge parts can be shifted in various incremental distances based on a multiple or fraction of the gauge spacing of the needles (or at other increments), so as to present various different yarns (e.g., different colors or types of yarns) to a plurality of stitch locations for a pattern being tufted, while the yarn feed can be selectively controlled to pull back or out at least some of the different yarns presented to each stitch location and to selectively feed amounts of yarns to form retained tufts of yarns to be shown at each stitch location in accordance with the pattern being tufted. The shifting of the needles and the gauge parts and presentation of the yarns to each stitch location will be coordinated with the yarn feed control, and the backing or cloth feed further can be controlled to move the backing at an actual stitch rate adapted to enable such presentation of several different yarns to each stitch location and retention of the selected tufts of yarns. In embodiments, the actual stitch rate can be based on a number of different yarns that will be presented to each stitch location, multiplied by the pitch or gauge spacing of the needles, divided by the actual increments at which the needles and gauge parts are shifted (e.g., a sewing gauge of the tufted article), and further multiplied by a desired or designed fabric or pattern stitch rate for the pattern.

In some embodiments, such as where, for example, a fabric stitch rate of the pattern is selected that substantially matches a gauge of the tufting machine, the pattern can have a substantially square construction and corresponding density based on such a substantially square construction. In some embodiments, by enabling selective control and variation of the sewing gauge of the tufted pattern being produced, the density of the resultant tufted fabrics can be varied substantially (e.g., being increased, and/or not being based on a square construction) to provide enhanced clarity and accuracy to the pattern being formed, without having to change the gauge spacing of the needles, and without necessarily being limited to formation of a substantially square construction for the pattern. For example, in embodiments, the density of the resultant tufted pattern can be non-square, e.g., having more tufts in either the longitudinal or lateral direction versus the other direction.

In embodiments, the tufting machine can include one needle bar, or in some embodiments, can include more than one needle bar, with the one or more needle bars having a series of needles mounted therealong. The backing or cloth feed can include backing feed rolls that are controlled to feed a backing (e.g., a primary backing material), through a tufting zone of the tufting machine and tufts of yarns can be introduced therein as the needles are reciprocated into and out of the backing.

In embodiments, at least one shift mechanism (e.g., a first or needle bar shifter) can be provided for shifting the at least one needle bar transversely across the tufting zone, and, in embodiments, at least one shift mechanism (e.g., a second or gauge bar shifter) can be provided for shifting the at least one gauge bar transversely across the tufting zone at one or more increments that substantially match the incremental movements of the needle bar. In some embodiments, multiple shift mechanisms can be utilized, such as for a tufting machine having more than one shifting needle bar. In addition, in embodiments, the at least one needle bar and at least one gauge bar can be linked to a common shifter or shifters, such as by a linkage assembly that can connect the at least one needle bar or the shifter to the at least one gauge bar so that the shifting movement of the at least one needle bar is translated to the at least one gauge bar to cause the at least one gauge bar to shift and move transversely with the at least one needle bar.

In embodiments, the needle bar and gauge bar shifter or shifters can be operable in response to control instructions from the control system so as to move in a substantially synchronous movement transversely with respect to the movement of the backing through the tufting zone such that the needles and their corresponding gauge parts are indexed at substantially a same selected incremental pitch or gauge distance, and thus can be maintained in substantial alignment with each other. In embodiments, the needles and the gauge parts can be shifted within different timing windows, as may be needed to help ensure accuracy of the presentation and pick up of yarns. In embodiments, the one or more shift mechanisms can comprise servo motor controlled shifters, mechanical shifters, which can include one or more cams, or other shifters configured for stepping or shifting the needles and the gauge parts transversely with respect to the backing in accordance with programmed and/or designed pattern shift steps for a pattern being tufted.

In embodiments, the gauge part assembly can include various types of gauge parts, including cut-pile hooks, loop pile loopers, level cut loopers or hooks, cut/loop hooks having biased clips attached thereto, and/or combinations of these and other gauge parts. The gauge parts generally can be mounted (e.g., in modules, or individually or in groups or sets) along at least one gauge bar located along the tufting zone and below the backing and can generally be arranged at the same gauge as the needles. The gauge parts are reciprocated into engagement with the needles as the needles penetrate the backing to pick loops of yarns therefrom.

In embodiments, a pair of backing support plates can be mounted along the front and rear or upstream and downstream sides of the tufting zone for supporting the backing as it is fed through the tufting zone. In embodiments, the backing support plates may not include reed fingers or wires defining spaces or gaps through which the needles are reciprocated, as generally required for conventional needle plates. Instead, the backing support plates generally will be configured to support the backing passing thereover without interfering with the shifting of the needles transversely. In some embodiments, the backing support plates may comprise substantially straight or flat forward edges. In embodiments, the forward edges of each backing support plate can be spaced apart by a distance sufficient to enable the needles to pass therebetween while supporting the backing against undue movement between the backing support plates. In some embodiments, one or both of the backing support plates can comprise a position-adjustable bedrail that can be moved to varying heights or elevations for forming tufts of different selected pile heights. In addition, in embodiments, a presser foot can be positioned along the rear or downstream side of the tufting zone, and can be operable to engage and hold a position of the backing while tufts or yarns are formed in the backing.

In embodiments, the yarn feed of the tufting machine can comprise at least one yarn feed mechanism or pattern attachment for controlling the feeding of the yarns to their respective needles. In embodiments, the yarn feed mechanism can include various roll, scroll, servo-scroll, single end, or double end yarn feed pattern attachments, such as, for example, an Infinity™ or Infinity IIE™ yarn feed pattern attachment as manufactured by Card-Monroe Corp. Other types of yarn feed control mechanisms also can be used. In embodiments, the at least one yarn feed mechanism or pattern attachment can be operated to selectively control the feeding of selected lengths of the yarns to their selected needles according to the pattern instructions or steps for forming each of the tufts of yarns, to enable formation of multiple fabric surfaces and/or multiple fabric pile heights including tufts having varying pile heights, to create the desired carpet pattern appearance.

In addition, in embodiments, the tufting machine can include puller rolls that can be located downstream from at least one yarn feed mechanism on each side of the tufting machine. The rotation of the puller rolls can be controlled by the control system to control pulling of the yarns from the yarn feed rolls of the at least one yarn feed mechanism to facilitate consistent, controlled feeding of the yarns along a path of travel to their needles.

In some embodiments, the control system can comprise programming configured to control the at least one yarn feed mechanism such that the yarns to be shown on the face or surface of the tufted article generally can be fed in amounts sufficient to form tufts of desired heights while the non-appearing yarns, which are not to be shown in the tufted field, can be pulled sufficiently low and/or out of the backing so as to avoid the creation of undesired gaps or spaces between and to minimize interference with the face of visible tufts of yarns retained at each stitch location of the pattern. For each pixel or stitch location of the pattern, a series of yarns generally will be presented, and yarns not selected for appearance at such pixel or stitch location can be pulled back and/or removed. Thus, only the desired or selected yarns/colors to be placed at a particular stitch location or pixel typically will be retained at such pixel or stitch location, while the remaining yarns/colors will be hidden in the pattern fields being sewn at that time, including pulling the yarns out of the backing so as to float on the surface of the backing. In embodiments, the control system further will include programming to control the operation of the shift mechanism(s) for indexing or shifting the at least one needle bar and at the least one gauge bar, including indexing or shifting the at least one needle bar and at least one gauge bar at varying, selectable off-gauge increments, and coordinated control of the feeding of yarns by the yarn feed mechanism(s) according to the instructions for the pattern being formed.

The formation of tufts of yarn in the backing further can be controlled so as to form a greater number of stitches per inch in the backing than what is needed or called for in the pattern, i.e., at increased actual or operative process stitch rates, with non-selected or non-retained tufts or stitches being removed or pulled so as to avoid creating and/or occupying a gap or space at which a selected color or stitch/tuft of yarn of the pattern is to be retained to provide for desired placement of selected types or colors of yarns at defined stitch locations or pixels of the pattern being formed and with a substantially enhanced resultant or actual selected density. The pattern further can be formed at selected, varying pile heights, including transitions and/or other sculptured effects through control of the yarn feed.

The feeding of the yarns to each needle can be independently controlled by the yarn feed system to provide enhanced precision and control as needed or desired to form tufts of yarns (e.g., loop pile tufts, cut pile tufts, or combinations thereof) in the backing as the backing passes through the tufting machine, in accordance with tufted pattern instructions or designs, and, in embodiments, with the backing being fed at an actual stitch rate that is greater than a desired or designed fabric or pattern stitch rate for the pattern being tufted.

Various aspects of tufting machines and systems for production of tufted articles are disclosed herein, including, without limitation, a tufting machine comprising: a cloth or backing feed configured to feed a backing through the tufting machine; at least one needle bar carrying a series of needles, wherein the needles are arranged along the needle bar at a gauge spacing; a yarn feed configured to feed a plurality of yarns to the needles; a series of gauge parts located below the backing and configured to pick-up yarns carried by the needles, wherein the gauge parts arranged in spaced series along at least one gauge bar; one or more backing supports over which the backing is passed; one or more shift mechanisms configured to shift the at least one needle bar and the at least one gauge bar transversely across the backing; wherein the one or more shift mechanisms are configured to shift the at least one needle bar and the at least one gauge bar in increments, including in increments that are less than the gauge spacing of the needles; and a control system including programming for controlling the feeding of selected yarns by the yarn feed mechanism to at least a portion of the needles such that selected yarns are picked up from the needles by the gauge parts. In some embodiments, the tufting machine can further comprise puller rolls that can be controlled by the control system to assist in feeding yarns from the yarn feed to the needles.

In addition, according to one aspect, a method of forming a tufted article comprises moving a backing though a tufting zone of a tufting machine; feeding a plurality of yarns to each of a series of needles and reciprocating the needles into and out of the backing; picking-up loops of yarns from the needles with a series of gauge parts located below the backing; shifting at least some of the needles carrying the plurality of yarns and at least some of the gauge parts together transversely with respect to the feeding of the backing though the tufting zone so as to present a desired number of yarns for insertion into the backing to each of a series of stitch locations for a pattern of the tufted article being formed; wherein the needles and the gauge parts are shifted together at selected sewing gauge increments based upon a multiple or a fraction of the gauge of the needle bar, e.g., in embodiments, at sewing gauge increments that are less than the gauge spacing between the needles so as to maintain the needles and their corresponding gauge parts in an aligned pitch relationship; and controlling feeding of selected yarns of the desired number of yarns presented to each stitch location so as to pull back or retain the selected yarns; wherein moving the backing through the tufting zone comprises feeding the backing at an actual or operative stitch rate approximately equivalent to a desired, designed or selected fabric or pattern stitch rate for the tufted article increased by a selected amount (e.g., multiplied by a number of colors or types of yarns of the pattern and further by a selected or designed density divided by the selected gauge at which the needles and gauge parts are shifted) to form the pattern.

According to other aspects, a tufting machine comprises backing feed rolls configured to feed a backing through the tufting machine; at least one needle bar carrying a series of needles, wherein the needles are arranged along the needle bar at a gauge spacing of the tufting machine; a yarn feed mechanism feeding a plurality of yarns to the needles; a series of gauge parts located below the backing and configured to pick-up yarns carried by the needles, the gauge parts being arranged in spaced series along at least one gauge bar; at least one backing support over which the backing passes; one or more shift mechanisms configured to shift the at least one needle bar and the at least one gauge bar transversely across the backing; wherein the one or more shift mechanisms are configured to shift the at least one needle bar and the at least one gauge bar together in a transverse movement with respect to the backing; and a control system including programming configured for controlling feeding of selected yarns by the yarn feed mechanism to at least a portion of the needles such that the selected yarns picked up from the needles by the gauge parts, and for controlling shifting of the at least one needle bar and the at least one gauge bar transversely with respect to the backing in shift increments that are less than or greater than the gauge spacing.

In embodiments of the tufting machine, the gauge parts can be arranged along the at least one gauge bar at the gauge spacing.

In embodiments of the tufting machine, the gauge parts can be mounted in a plurality of modules; and wherein the modules are releasably secured to the gauge bar.

In embodiments of the tufting machine, the control system further comprises programming configured for coordinating shifting of the needles by the one or more the shift mechanisms and feeding of the backing by the backing feed rolls with control of the yarn feed mechanism so as to present a series of yarns of the plurality of yarns to selected stitch locations along the backing as the backing is moved at an actual stitch rate such that an increased number of tufts per inch can be formed in the backing, and to enable non-selected yarns of the series of yarns presented to be pulled low or substantially out of the backing while selected yarns of the series of yarns presented are maintained at the selected stitch locations to form a pattern of tufts in the backing.

In embodiments of the tufting machine, the gauge parts comprise level cut loop loopers, cut pile hooks, and/or combinations thereof.

In embodiments of the tufting machine, the yarn feed mechanism comprises at least one of a scroll, roll, single end or double end yarn feed pattern attachment.

In embodiments of the tufting machine, the control system further includes programming configured to control shifting of the at least one needle bar and the at least one gauge bar in non-uniform increments that are based on a multiple of the gauge spacing.

In embodiments of the tufting machine, the control system further includes programming configured to control shifting of the at least one needle bar and the at least one gauge bar in non-uniform increments that are not based on a multiple of the gauge spacing.

In another aspect, a method of forming a tufted article comprises: moving a backing over at least one backing support; feeding a plurality of yarns to a plurality of needles as the needles are reciprocated into and out of the backing; picking loops of yarns from the needles with gauge parts located below the backing; shifting the needles carrying the plurality of yarns and shifting corresponding gauge parts transversely with respect to the feeding of the backing; wherein the needles and their corresponding gauge parts are shifted together by approximately a same distance so as to maintain the needles and their corresponding gauge parts in a substantially pitched relationship; presenting each yarn to a stitch location along the backing according to a pattern of the tufted article being formed; if the yarn is selected to be retained at the stitch location, controlling feeding of the yarn so as to retain a tuft of the yarn, and if the yarn is not selected to be retained, controlling feeding of the yarn so as to pull back the yarn to an extent that the yarn does not interfere with a tuft of a yarn selected to be retained at the stitch location; and wherein moving the backing along the backing support comprises feeding the backing at an actual stitch rate approximately equivalent to a fabric stitch rate for the pattern increased by a selected amount.

According to other aspects, a method of tufting a patterned tufted article having a designed pattern stitch rate and a pattern density comprises: threading a series of needles with different color or type yarns in a selected sequence; wherein the needles are positioned at a first spacing along at least one needle bar; moving a backing through a tufting zone at an actual stitch rate that is at least two times the designed pattern stitch rate for the patterned tufted article; picking loops of yarns from the needles with a series of gauge parts; wherein the gauge parts are mounted along at least one gauge bar with the gauge parts arranged at a second spacing; wherein the second spacing of the gauge parts is substantially equal to the first spacing of the needles; shifting the at least one needle bar and the at least one gauge bar transversely with respect to the backing sufficient to present a series of different color or type yarns to a series of stitch locations in the backing; and wherein the at least one needle bar and the at least one gauge bar are shifted by a selected shift distance so as to maintain the needles and gauge parts in a pitch relationship.

In embodiments, the selected shift distance is user selectable and is less than the first and second spacings.

In embodiments, the patterned tufted article is formed with a selected density that is greater than the pattern density.

In embodiments, the method further comprises controlling feeding of different color or type yarns presented to each of the stitch locations, and retaining at least one selected yarn of the series of different color or type of yarns presented at each of the stitch locations so as to form tufts of the selected yarns at each of the stitch locations, with remaining ones of the series of yarns presented at each of the stitch locations being at least partially removed from the backing.

In other aspects, a tufting machine is provided, comprising: backing feed rolls feeding a backing through the tufting machine; at least one needle bar carrying a series of needles; a yarn feed mechanism feeding a plurality of yarns to the needles; at least one gauge bar carrying a plurality of gauge parts configured to pick-up yarns from the needles; at least one backing support configured to support the backing as the backing is fed through the tufting machine; one or more shift mechanisms configured to shift the at least one needle bar and the at least one gauge bar transversely across the backing; and a control system including programming for controlling the one or more shift mechanisms to shift the at least one needle bar and the at least one gauge bar in substantially matching movements transversely across the backing in shift increments having a length less than a spacing between the needles along the at least one needle bar so as to present an increased number of yarns to each of a plurality of stitch locations, and controlling the feeding of selected yarns by the yarn feed mechanism to at least a portion of the needles such that the selected yarns picked up from the needles by the gauge parts; and wherein patterned tufted carpets are formed having a resultant pattern density that is greater than a designed density of a pattern as designed.

In embodiments of the tufting machine, the control system further comprises programing configured to control feeding of the backing through the tufting machine at an actual stitch rate determined by the designed density of the pattern divided by the length of the shift increments at which the at least one needle bar and the at least one gauge bar are moved, multiplied by a number of colors of yarns of the pattern and by a pattern stitch rate of the pattern as designed.

According to other aspects, a tufting machine is provided, comprising: at least one needle bar having a series of needles arranged therealong at a first spacing; a yarn feed mechanism feeding a plurality of yarns to the needles; a series of gauge parts configured to pick-up yarns carried by the needles; wherein the gauge parts are arranged along at least one gauge bar at a second spacing; one or more shift mechanisms configured to shift the at least one needle bar and the at least one gauge bar in a transverse direction with respect to a backing moving through the tufting machine; and a control system including programming configured for controlling feeding of yarns by the yarn feed mechanism to the needles to form tufts of selected yarns picked up from the needles by the gauge parts at a selected pile height, and for controlling shifting of the at least one needle bar and the at least one gauge bar transversely with respect to the backing in shift increments that are less than or greater than the first spacing.

In embodiments, the second spacing at which the gauge parts are arranged along the at least one gauge bar is substantially equal to the first spacing of the needles along the at least one needle bar.

In embodiments, the gauge parts are mounted in a plurality of modules; and wherein the modules are releasably secured to the gauge bar.

In embodiments, the control system further comprises programming configured for coordinating shifting of the at least one needle bar by the one or more the shift mechanisms and feeding of the backing with control of the yarn feed mechanism so as to present a series of yarns of the plurality of yarns to selected stitch locations along the backing as the backing is moved at an actual stitch rate such that an increased number of tufts per inch can be formed in the backing, and to enable non-selected yarns of the series of yarns presented to be pulled back not interfere with a placement of the selected yarns at a corresponding stitch location while the selected yarns are maintained at the selected stitch locations to form a pattern of tufts in the backing.

In embodiments, the gauge parts comprise level cut loop loopers, cut pile hooks, and/or combinations thereof.

In embodiments, the yarn feed mechanism comprises at least one of a scroll, roll, single end or double end yarn feed pattern attachment.

In embodiments, the control system further includes programming configured to control shifting of the at least one needle bar and the at least one gauge bar in non-uniform increments that are based on a multiple of the gauge spacing.

In embodiments, the control system further includes programming configured to control shifting of the at least one needle bar and the at least one gauge bar in non-uniform increments that are not based on a multiple of the gauge spacing.

In other aspects, a method of forming a patterned tufted article having a designed pattern stitch rate and a designed pattern density comprises: moving a backing through a tufting machine; feeding a plurality of yarns to a plurality of needles as the needles are reciprocated into and out of a backing moving therebelow; picking loops of yarns from the needles with a plurality of gauge parts; shifting the needles and the gauge parts transversely with respect to a direction of movement of the backing; wherein the needles and the gauge parts are shifted together by approximately a same distance so as to maintain the needles and the gauge parts in a substantially pitched relationship; presenting one or more yarns to one or more stitch locations along the backing according to a pattern of the patterned tufted article being formed; if the yarn is selected to be retained at the one or more stitch locations, controlling feeding of the yarn so as to retain a tuft of the yarn, and if the yarn is not selected to be retained, controlling feeding of the yarn so as to pull back the yarn to an extent that the yarn does not interfere with formation of a tuft of a yarn selected to be retained at the one or more stitch locations; and wherein moving the backing through the tufting machine comprises feeding the backing at an actual stitch rate approximately equivalent to a fabric stitch rate for the pattern increased by a selected amount.

In embodiments, the method further comprises: threading a series of needles with different color or type yarns in a selected sequence; wherein the needles are positioned at a first spacing along at least one needle bar, and the gauge parts are mounted along at least one gauge bar at a second spacing; moving a backing through a tufting zone at an actual stitch rate that is at least two times the designed pattern stitch rate for the patterned tufted article; shifting the at least one needle bar and the at least one gauge bar transversely with respect to the backing sufficient to present a series of different color or type yarns to the one or more stitch locations along the backing; and wherein the at least one needle bar and the at least one gauge bar are shifted by a selected shift distance so as to maintain the needles and gauge parts in a pitch relationship.

In embodiments, the selected shift distance is user selectable and is less than the first and second spacings.

In embodiments, the patterned tufted article is formed with a selected density that is greater than the pattern density.

In embodiments, the method further comprises controlling feeding of different color or type yarns presented to the one or more stitch locations, and retaining at least one selected yarn of a series of different color or type yarns presented at the one or more stitch locations so as to form tufts of the selected yarns at the one or more stitch locations, with remaining ones of the series of different color or type yarns presented at the one or more stitch locations being at least partially removed from the backing.

According to another aspect, a tufting machine comprises: a backing feed configured to feed a backing along a path of travel through the tufting machine; at least one needle bar carrying a series of needles; a yarn feed mechanism configured to feed a plurality of yarns to the needles; at least one gauge bar carrying a plurality of gauge parts configured to pick-up yarns from the needles; one or more shift mechanisms configured to shift the at least one needle bar and the at least one gauge bar transversely with respect to the path of travel of the backing; and a control system including programming configured for controlling the one or more shift mechanisms to shift the at least one needle bar and the at least one gauge bar in substantially transversely across the backing in shift increments having a length less than or equal to a gauge spacing between the needles along the at least one needle bar so as to present an increased number of yarns to each of a plurality of stitch locations, and for controlling the feeding of selected yarns by the yarn feed mechanism to at least a portion of the needles such that the selected yarns picked up from the needles by the gauge parts; and wherein patterned tufted carpets are formed having a resultant pattern density that is greater than a designed density of a pattern as designed.

In embodiments, the control system further comprises programing configured to control feeding of the backing through the tufting machine at an actual stitch rate determined by the designed density of the pattern divided by a length of the shift increments at which the at least one needle bar and the at least one gauge bar are shifted, multiplied by a number of colors of yarns of the pattern and by a pattern stitch rate of the pattern as designed.

In embodiments, the control system further includes programming configured to control shifting of the at least one needle bar and the at least one gauge bar in non-uniform increments that are based on a multiple of the gauge spacing between the needles.

In embodiments, the control system further includes programming configured to control shifting of the at least one needle bar and the at least one gauge bar in non-uniform increments that are not based on a multiple of the gauge spacing between the needles.

In embodiments, the tufting machine further comprises a backing support over which the backing is moved.

In embodiments, the one or more shift mechanisms comprise at least one shift mechanism coupled to the at least one needle bar and configured to control the shifting of the at least one needle bar, and at least one shift mechanism coupled to the at least one gauge bar and configured to control the shifting of the at least one gauge bar independently of the shifting of the at least one needle bar.

In embodiments, the gauge parts are arranged along the at least one gauge bar at a spacing that is substantially equal to the gauge spacing of the needles along the at least one needle bar.

Still other aspects, embodiments, features, and advantages of these and exemplary aspects and embodiments, are discussed in detail below. Moreover, it is to be understood that both the foregoing information and the following detailed description are merely illustrative examples of various aspects and embodiments and are intended to provide an overview or framework for understanding the nature and character of the claimed aspects and embodiments. Accordingly, these and other objects, along with advantages and features of the present disclosure provided herein, will become apparent through reference to the following description and the accompanying drawings. Furthermore, it is to be understood that the features of the various embodiments described herein are not mutually exclusive and can exist in various combinations and permutations.

DESCRIPTION OF DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein.

DETAILED DESCRIPTION

Figure 1A:
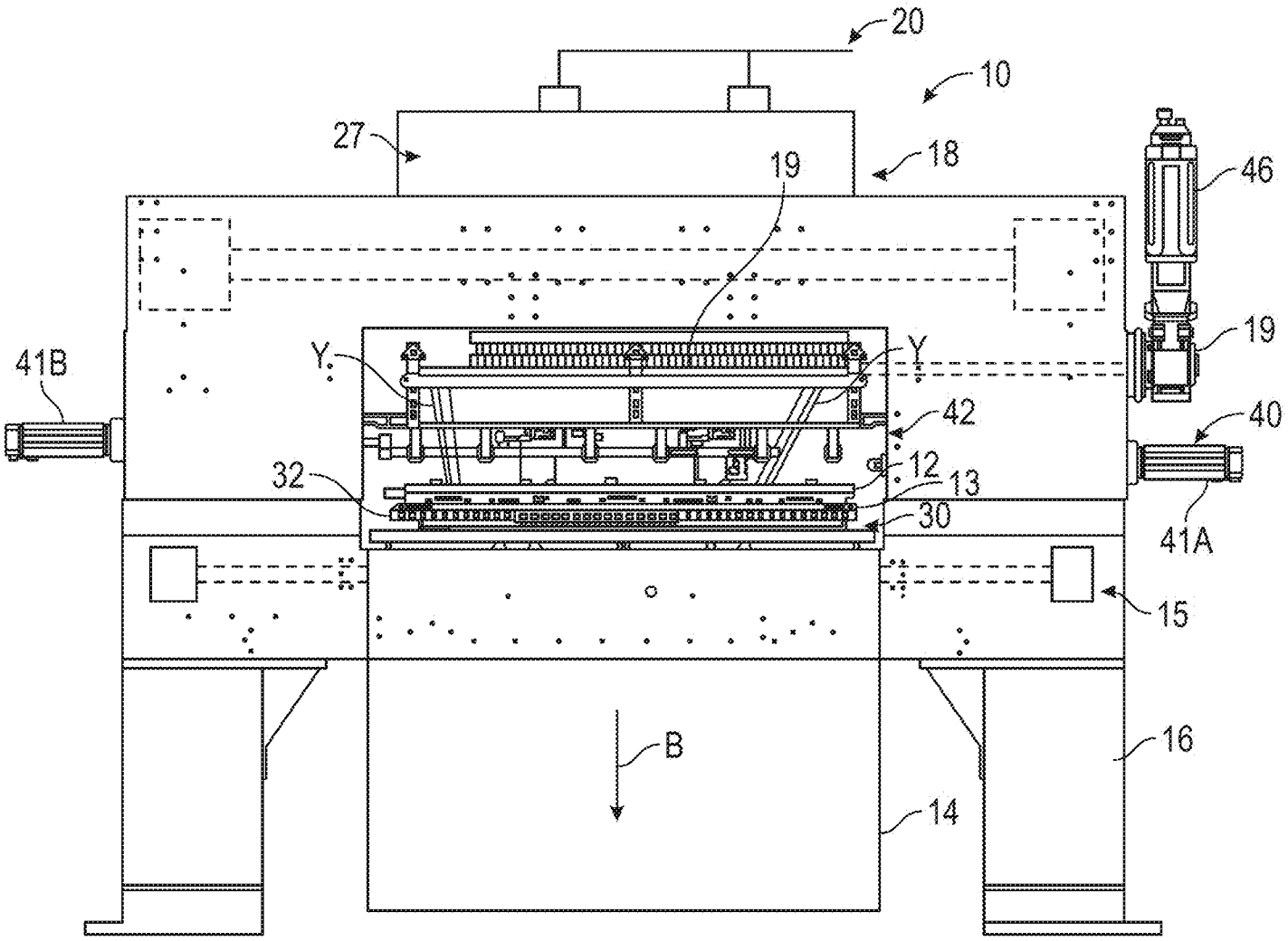
FIGS. 1A and 1B are side elevational views of the rear or downstream side of one embodiment of a tufting machine configured for forming selectable gauge tufted articles in accordance with the principles of the present disclosure.

The present disclosure can be understood more readily by reference to the following detailed description, examples, drawings, and claims, and their previous and following description. However, before the present devices, systems, and/or methods are disclosed and described, it is to be understood that this present disclosure is not limited to the specific devices, systems, and/or methods disclosed unless otherwise specified and, as such, can of course vary. It is also to be understood that the terminology used herein is for the purpose of describing particular aspects only and is not intended to be limiting.

The following description of the present disclosure is provided as an enabling teaching of the present disclosure in its best, currently known embodiment. To this end, those skilled in the relevant art will recognize and appreciate that many changes can be made to the various aspects of the present disclosure described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment.

The phraseology and terminology used herein is for the purpose of description and should not be regarded as limiting. As used herein, the term "plurality" refers to two or more items or components. In addition, terms such as "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one element having a certain name from another element having a same name to distinguish claim elements.

Disclosed are systems, equipment and components of embodiments of the tufting machine and that can be used to perform embodiments of the methods of the present disclosure. These and other components are disclosed herein, and it is understood that when combinations, subsets, interactions, groups, etc. of these components are disclosed, specific reference to each various individual and collective combinations and permutation of these may not be explicitly disclosed, but each is specifically contemplated and described herein for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Referring now in greater detail to the drawings in which like numerals indicate like parts throughout the several views, FIGS. 1A-6 generally illustrate example embodiments of a tufting machine 10 and methods for controlling the operation of the tufting machine 10 of the present disclosure, which, in embodiments, can be configured to enable use of a standard gauge set-up of a tufting machine for forming multiple different gauge tufting articles without requiring a change to the initial or selected machine or needle gauge spacing; including enabling formation of increasingly finer gauge tufted articles. For example, in some embodiments, the tufting machine can be configured with $1/8^{th}$, $1/10^{th}$, or $1/12^{th}$, etc. gauge needle bars 12, where both the needles 13 and a plurality of gauge parts 32 (FIGS. 1B-5) of a gauge part assembly 30 are arranged along at least one needle bar 12 and at least one gauge bar 33, respectively, at a same first gauge spacing (e.g., based on a needle or machine gauge spacing or other selected spacing); and are selectively indexed or stepped transversely with respect to the movement of a backing 14 (which can comprise a primary backing material or fabric) passing through the tufting machine and beneath the needles 13 in the direction of Arrow B.

In embodiments, the needles can be indexed or shifted in increments that are less than the gauge of the needle bar of the tufting machine to enable greater precision and control in the formation of tufts of yarn. The increments can allow for motion of a plurality of different, finer gauge tufted articles using a single same gauge setup of a tufting machine (e.g., using a $1/10^{th}$ gauge tufting machine configured with a $1/10^{th}$ gauge needle bar to tuft patterned carpets, turf, rugs, etc. with a variety of different sewing gauges, e.g., $1/5^{th}$, $1/7^{th}$, $1/8^{th}$, 5/32nd, $1/10^{th}$, $1/12^{th}$, $1/16^{th}$, $1/20^{th}$, $1/30^{th}$, $1/40^{th}/1/50^{th}$, etc.) and with enhanced resolution and accuracy at enhanced production speeds.

In embodiments, the tufting machines and methods of tufting according to the present disclosure can be operated to form finer gauge tufted articles, such as, for example, $1/5^{th}$, $1/7^{th}$, $1/8^{th}$, 5/32nd, $1/10^{th}$, $1/12^{th}$, $1/16^{th}$, $1/20^{th}$, $1/30^{th}$, $1/40^{th}/1/50^{th}$, etc. gauge fabrics, using one tufting machine set-up (e.g., a $1/8^{th}$, $1/10^{th}$, etc. gauge needle bar), without necessarily having to change the gauge spacing of the needles and gauge parts each time a different gauge tufted article is to be run. In some embodiments, a needle bar (or bars) and a gauge bar (or bars) of the tufting machines can be indexed or shifted at shift increments having a length that is lesser than or greater than a gauge spacing of the needles and gauge parts (e.g., a first spacing of the needles and/or a second spacing of the gauge parts, which can be the same or different spacings), so as to form a variety of smaller or finer gauge, larger gauge, and/or non-standard gauge fabrics, such as $1/5^{th}$, $1/8^{th}$, $1/7^{th}$, $1/11^{th}$ gauge, etc. tufted fabrics, with enhanced resolution. In addition, in embodiments, the resultant density of the patterned tufted articles can be changed, e.g., increased, over a designed or selected density of the pattern to provide greater clarity and accuracy of the pattern as tufted.

Embodiments of the tufting machine 10 and methods can be utilized to forming or tufting stitches or tufts of yarns Y at desired locations in the backing 14, including forming tufts or stitches with a sculptured, multi-pile height tufted appearance, and further can be placed with enhanced selectivity, for formation of other varying or free-flowing pattern effects. In example embodiments, the tufted article can be formed with cut pile tufts, loop pile tufts, and/or combinations of cut and loop pile tufts, including such tufts being formed in the same tuft rows, with the tufts formed at varying pile heights to provide sculptured looks, and formation of multi-color patterns of various geometric and/or free-flowing designs. Additionally, it will be understood that various numbers of different type and/or color yarns (i.e., two colors of yarns, three colors of yarns, four colors of yarns, five colors of yarns, six colors of yarns, etc.), can be used to form the sculptured, multiple pile height patterned tufted articles according to the principles of the present disclosure.

As indicated in FIGS. 1B-6 in embodiments, the tufting machine 10 generally can include a frame 16, with a machine main drive shaft that can be driven by one or more motors, and which in turn can drive a series of push rods in a substantially vertically reciprocating motion so as to reciprocally drive at least one needle bar 12 carrying the plurality of needles 13 mounted in a spaced series therealong into and out of the backing 14. The tufting machine further can include a cloth or backing feed 15, which can include a series of backing feed rolls, including, in embodiments, one or more spike rolls, driven by motors for feeding the backing 14 along a path of travel B through a tufting zone T defined beneath the needles of the tufting machine and a yarn feed 18. Puller rolls 19 also can be provided between a yarn feed for feeding the yarns Y and the needles, and generally can be configured to pull/assist the yarns Y fed by the yarn feed for feeding to the needles 13.

In some embodiments, an encoder can be provided for monitoring the rotation of the main drive shaft and reporting a position of the main drive shaft to a control system 20 (FIG. 2A) for controlling the operation of the tufting machine 10. In embodiments, the control system 20 can include a computer/processor or controller 21 with an operator interface 22 through which the operator can input patterns, check machine status information, etc. In embodiments, the control system 20 may comprise programming to monitor and control the various operative elements of the tufting machine, such as the reciprocation of the needle bars 12 and/or backing feed 15, the shifting of the needle bars, backing support plate(s) 35 or bedplate positions, the feeding of the yarns, etc. in accordance with the calculated/determined pattern instructions for the pattern being tufted.

In some embodiments, the controller 21 of the control system 20 generally can be linked to and/or incorporated with the tufting machine. For example, in embodiments, the controller 21 can be housed within a cabinet or work station that can be located adjacent the tufting machine frame, and can include a control computer and/or one or more processors; and the operator interface 22, which that can include, for example, a monitor, an input device, such as a keyboard, mouse, keypad, drawing tablet, or similar input device or system, as would be recognized by those skilled in the art. In addition, the monitor could be a touch screen type monitor to enable operator input to the controller.

Still further, it will be understood by those skilled in the art that while the controller 21 has been disclosed in an example embodiment as including a separate work-station, or as being housed a separate cabinet, the controller further can be otherwise integrated or coupled to the tufting machine 10. For example, in some embodiments, the controller could be mounted to the tufting machine frame 16 and could include a monitor and operator interface configured to enable an operator to monitor and/or control the operation of the tufting machine. It is also may be possible to include the controller 21 as part of an overall operational control system, with the control functions of the yarn feed 18, backing or cloth feed 15, puller rolls 19, and one or more shift mechanisms 40 adapted to control the shifting movement of the needles 13 and the gauge parts 32 transversely with respect to the movement of the backing 14 through the tufting zone T of the tufting machine 10 and other operative components of the tufting machine being controlled and operated with a single operator interface. In some embodiments, the control system can be linked to a remote server that can provide control commands or instructions to the tufting machine.

In embodiments, the control system 20 (FIG. 2A) further can receive and execute or store pattern information in a memory/storage of the controller 21. In response to received/developed or programmed pattern instructions, the control system will control the operative elements of the tufting machine 10 in order to form desired or selected tufted patterns in the backing 14 as the backing is passed through the tufting zone T in the direction of arrow B by the backing or cloth feed 15.

In some embodiments, the controller 21 of the control system 20 can be programmed with instructions for forming one or more desired patterns for one or more tufted articles, including a series of pattern steps. In embodiments, such patterns and the instructions or pattern steps thereof can be created or calculated manually or through the use of design centers or design software as understood by those skilled in the art. Alternatively, the control system can include image recognition software or other programming (which, in embodiments, can be programmed into the controller of the control system), and/or can be connected to a scanner to enable control by scanned and/or designed pattern images (as well as photographs, drawings, and other images to be input, recognized, and processed by the control system). The pattern instructions and/or steps run by the controller (e.g., as designed or as created by the control system based on a scanned pattern image) further can include pile heights and other pattern characteristics, such as the placement of loop pile and cut pile tufts in the pattern as shown by, for example, different colors or similar markers or indicators in the designed pattern images. The control system can thus recognize and identify various pattern characteristics, including colors and/or difference in texture, of a designed pattern image indicative of certain texture effects and can assign selected yarns thereto.

Additionally, in embodiments, the control system 20 can operate with or comprise functionality, including software or programming configured to receive and execute pattern instructions for forming a selected input, designed, or programmed pattern. In embodiments, the control system can further comprise or include functionality software/programming configured to read and recognize colors of an input scanned pattern and can assign supply positions for the yarns Y being supplied from a supply creel to various ones of the needles 13 based on the thread-up sequence of the needles of the needle bar 12 so as to optimize the supplies of the various color yarns in the creel for the best use thereof, and, in embodiments, to form recognized pattern fields from pattern images.

The control system 20 further can create pattern fields or mapping of the pattern, including a series of pattern pixels or tuft/stitch placement locations identifying the spaces or locations at which the various color yarns and/or cut/loop pile tufts will be selectively placed to form the imaged pattern. The desired pattern density (i.e., the desired number of stitches per inch to appear on the face of the finished patterned tufted article) also can be analyzed and an actual or operative process stitch rate for the pattern calculated to achieve the appearance of a fabric or stitch rate of the scanned and/or designed pattern.

The control system 20 of the present disclosure further can include programming to receive, determine and/or execute various shift or cam profiles, or can calculate a proposed shift profile based on the scanned or input designed pattern image. Effectively, in one embodiment, a designed pattern image, photograph, drawing, etc., can be scanned, loaded or otherwise input directly at the tufting machine, and the control system can read, recognize and calculate the pattern steps/parameters (including control of yarn feed, backing movement, needle reciprocation, cam or shift profile for the pattern, and the arrangement of yarns to match the scanned and/or designed pattern image) and can thereafter control the operation of the tufting machine to form the scanned and/or designed pattern image.

In some embodiments, an operator additionally can select a desired cam profile or modify the calculated shift profile, such as by indicating whether the pattern is to have 2, 3, 4, 5 or more colors, or a desired number of pattern repeats, and/or can manually calculate, input and/or adjust or change the creel assignments, shift profiles and/or a color mapping created by the control system as needed via a manual override control/programming. By way of example, the needles can be arranged at a first spacing along the needle bar such as at 0.125 inch ($1/8^{th}$ gauge), 0.10 inch ($1/10^{th}$ gauge), 0.0833 inch ($1/12^{th}$ gauge), etc., which can be set for the tufting machine.

As indicated in FIGS. 1B-3, the tufting machine 10 can include one or more needle bars 12 attached to and driven by the needle drive system. In the embodiments illustrated, a single needle bar 12 is shown having a series of needles 13 arranged therealong at a first spacing, e.g., at a needle bar or machine gauge, though other spacings also can be used. The needle bar 12 is driven in a reciprocating motion by the needle drive system so as to move the needles 13 into and out of the backing 14, so as to carry or insert the yarns Y into the backing. In some embodiments, multiple needle bars can be used.

In addition, in embodiments, the needles 13 can be arranged in a single in-line row along one or two needle bars, while in other embodiments, the needles can be mounted in a staggered arrangement, with offset rows of needles spaced transversely along the length of one or a pair of needle bar(s) and across the tufting zone of the tufting machine. The needle bar 12 further can be shiftable transversely across the width of the backing material as indicated by arrows 23/23' (FIGS. 1B-3). In addition, while only a single needle bar 12, with an inline row of needles 13 arranged therealong is shown in the FIGS. 4A-C, it will be understood by those skilled in the art that additional arrangements of single and/or dual needle bars having spaced rows of needles 13 arranged in-line or in a staggered or offset configuration, and which further can be shifted, also can be utilized in the tufting machine 10 incorporating the system according to the present disclosure.

The needles 13 are reciprocated such that they penetrate into and out of the backing 14, carrying the yarns Y therewith. As the needles penetrate the backing, loops of yarns are picked-up from the needles by the gauge parts 32 of the gauge part assembly 30 for forming tufts of yarns in the backing. The gauge parts generally will be arranged along at least one gauge bar 33 located along the tufting zone T and below the backing. In various embodiments, the gauge part assembly 30 can include various types of gauge parts 32, including cut-pile hooks, loop pile loopers, level cut loopers or hooks, cut/loop hooks having biased clips attached thereto, and/or combinations of these and other gauge parts.

For example, in embodiments, loop pile loopers can be provided to form loop piles tufts, while in other embodiments, cut pile hooks and knives can be provided for forming cut pile tufts. In still other embodiments, a series of the level cut loop loopers can be used, each having movable clips that can be individually controlled based on the pattern stitch being formed and/or shift profile step. The loopers can be selectively actuated for each tuft according to whether the loops of yarn being formed thereby are to be released along the level cut loop loopers, such as for forming loop pile tufts, or are to be retained on the level cut loop loopers and cut with a knife to form a cut pile tuft. In still further embodiments, various configurations and/or combinations of loop pile loopers, cut pile hooks, cut/loop hooks and/or level cut loop loopers also can be used.

The gauge parts 32 can be mounted along the gauge bar 33 at a second spacing. In embodiments, the second spacing of the gauge parts will be substantially equal to the first spacing of the needles along the needle bar. In embodiments, the gauge parts further can be shiftable together with the needles in the direction of arrows 23/23' to maintain the needles and gauge parts at a same pitch.

Figure 4A:
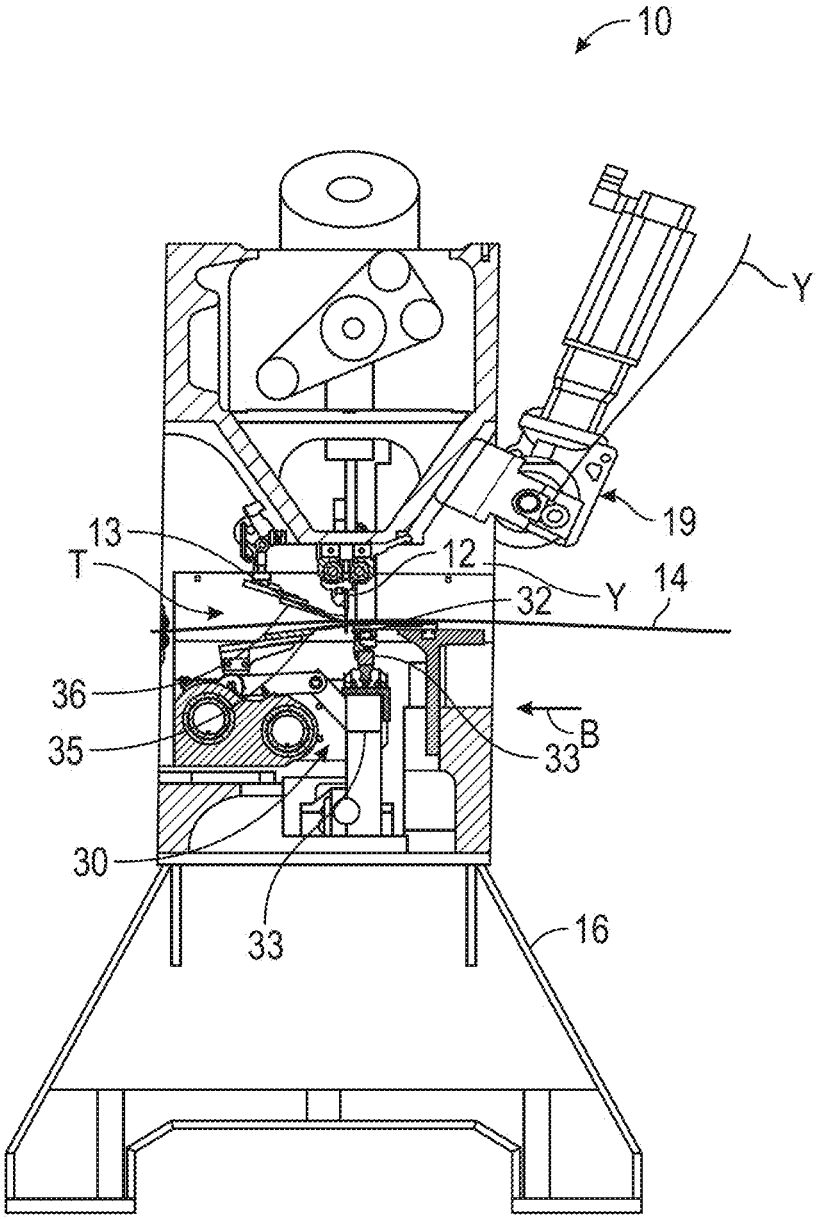
FIGS. 4A-4C are end elevation views of the tufting machine of FIGS. 1A-3, taken from the left and right side ends thereof.
Figure 4B:
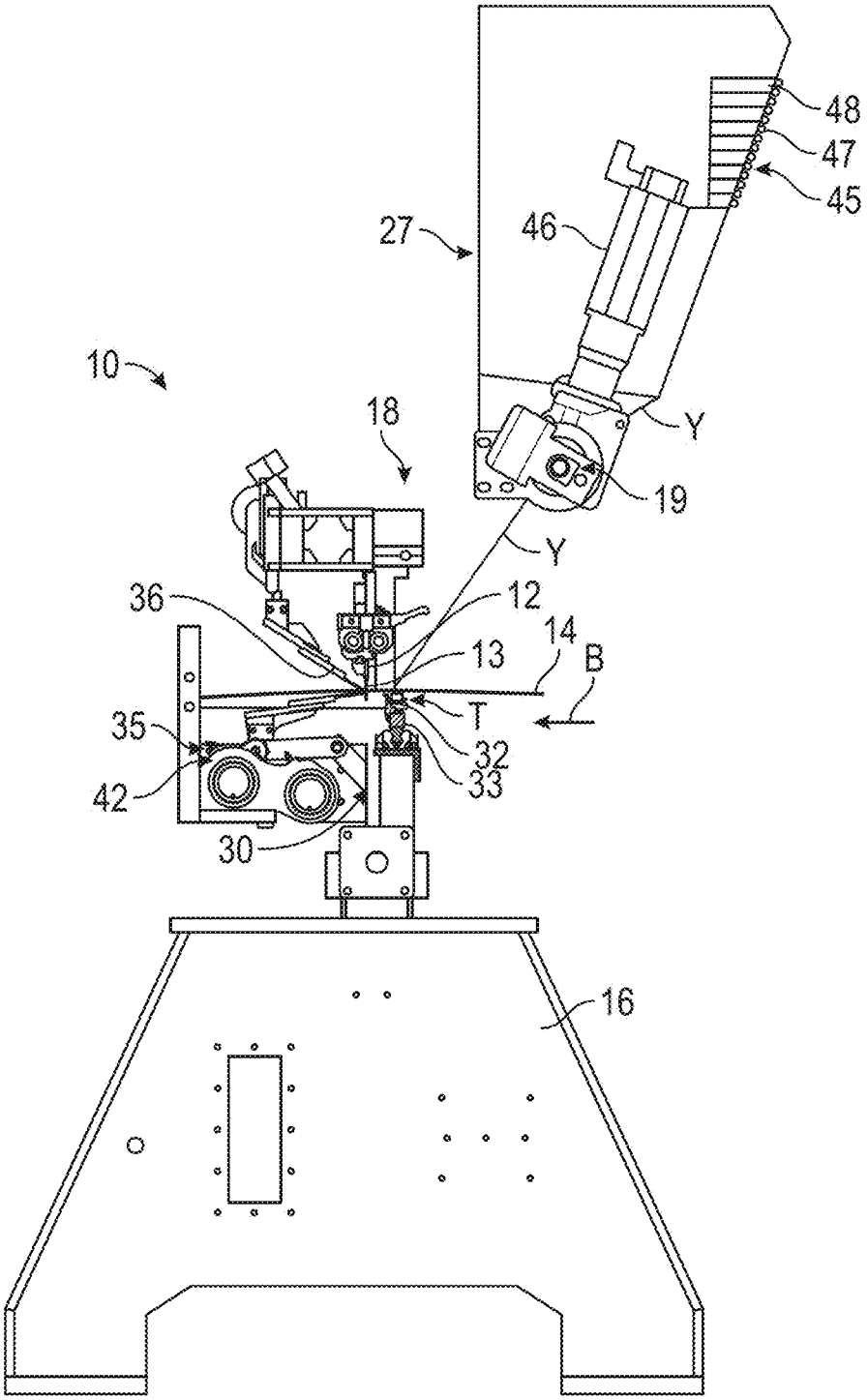
Figure 4C:
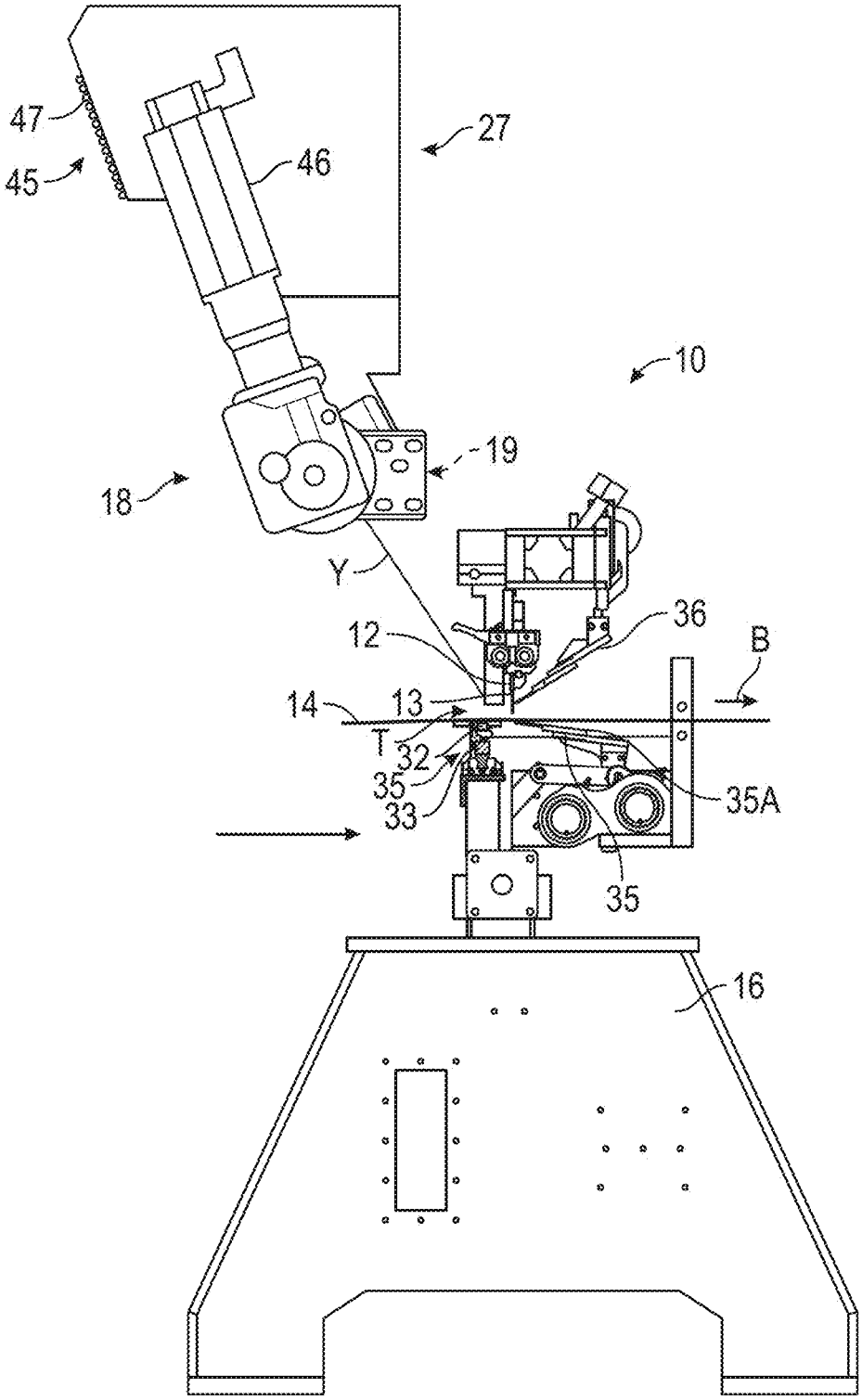

Additionally, as illustrated in the embodiments shown in FIGS. 2, 3A and 4B, in some embodiments a shift mechanism 40 can be linked to the needle bar 12 (or needle bars) for shifting the needle bar in the direction of arrows 23 and 23', transversely across the tufting zone T according to calculated or computed pattern instructions. The shift mechanism 40 can include various servo positioning types of shift mechanisms including servo-motor or hydraulically controlled shifters, mechanical shifters such as cam shifters, and/or other shifters.

As shown in FIGS. 1B-3, in embodiments, the needle bar 12 and the gauge bar 33 each can be coupled to its own shifter, as indicated at 41A and 41B. These shifters can be mounted, for example, on opposite sides of the tufting machine and, in some embodiments, can be operated in conjunction with each other under instructions from the control system to shift the needle bar and gauge bar in a generally synchronous movement so as to index the gauge parts and the needles transversely across the tufting zone in the direction of arrows 23 and 23' in a substantially pitched relationship. Alternatively, in embodiments, the gauge parts and the needles can be shifted independently and at different shift distances or increments; and in some further embodiments, only one of the needle bar or the gauge bar can be shifted, while the other one of the needle bar or gauge bar can be generally maintained in position, for example, for running more traditional patterns or styles. Each of the needle bar and the gauge bar further can be mounted to linear guides 37 (FIGS. 7A-7B) and/or slide mechanisms 38 to facilitate the indexing or shifting movement thereof.

In embodiments, the needle bar and the gauge bar can be shifted at different timing windows (e.g., there can be two timing windows, one for the needle bar and one for the gauge bar) such that the shifting or indexing movement of the needle bar and the gauge bar can be started and stopped at different times with respect to one another as needed to ensure accurate movement of the needles and the gauge parts in a substantially similar pitch relationship transversely with respect to the backing, without interfering with the presentation and retention of various colors or types of yarns in the backing for forming tufts of yarns therein. In addition, in some embodiments, the gauge bar can be maintained substantially stationary for or during some steps of the pattern, or during some pattern runs. Still further, in other embodiments, the needle bar and/or the gauge bar can be shifted or indexed so as to move the needles and/or the gauge parts standard increments or other increments, such as shifting the needles and/or gauge parts in single or multiple gauge jumps or steps.

Figure 6:
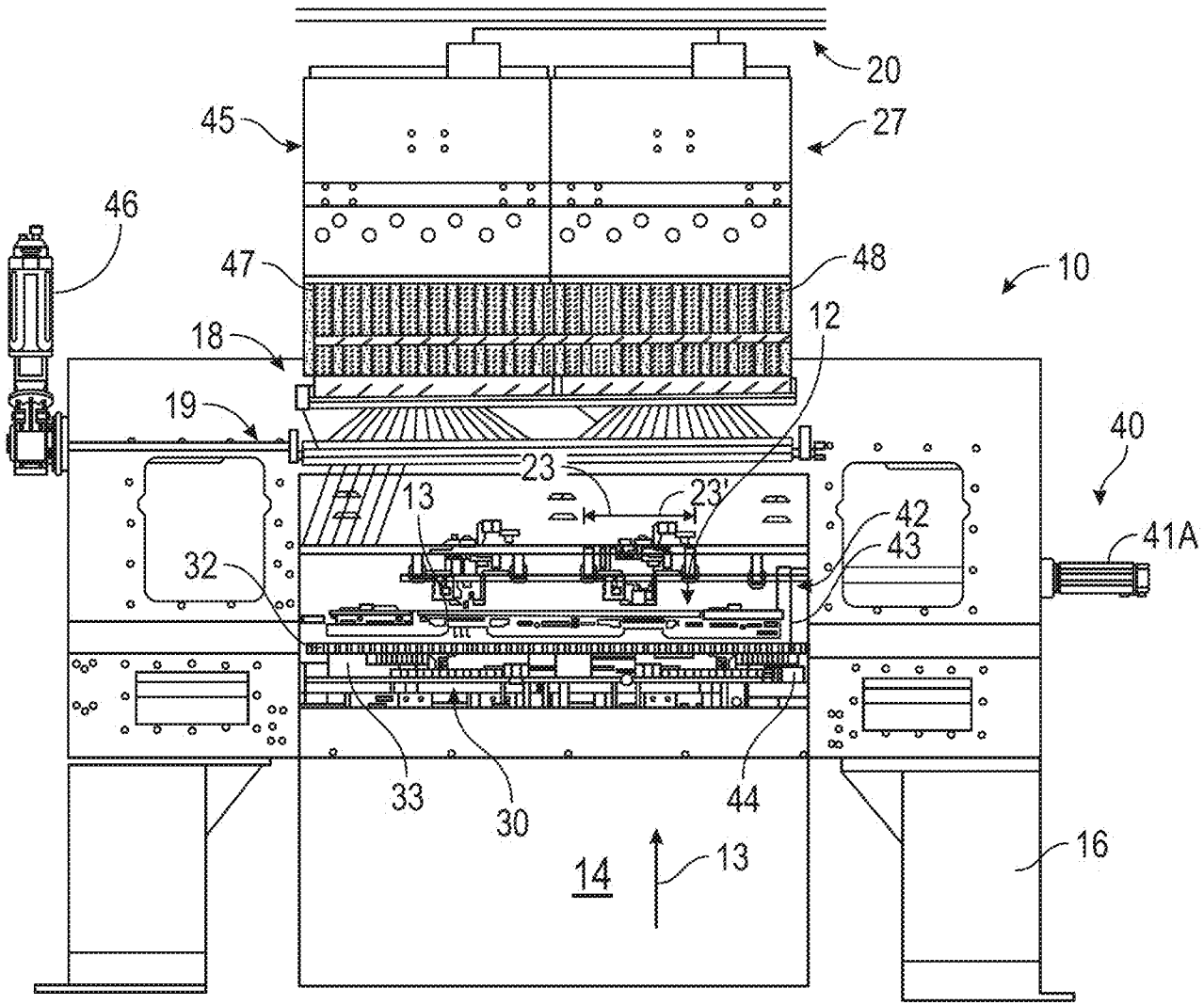
FIG. 6 illustrates a front view of an alternative embodiment of a tufting machine configured for forming selectable gauge tufted articles in accordance with the principles of the present disclosure.
Figure 7A:
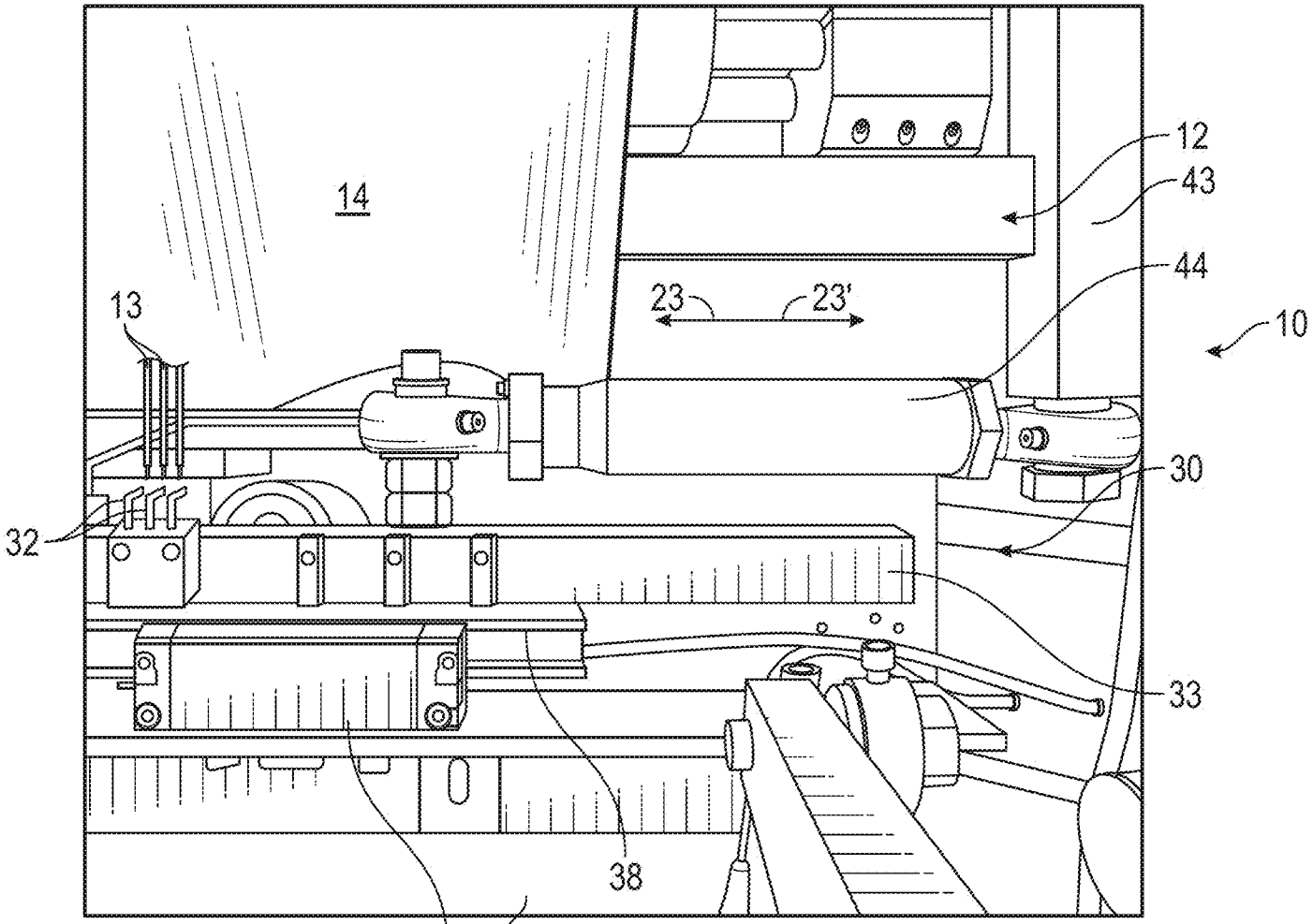
FIGS. 7A-7B illustrate an example embodiment of a linkage assembly for linking a needle bar and a gauge bar to a shift mechanism for shifting the needle bar and the gauge bar in accordance with the principles of the present disclosure.
Figure 7B:
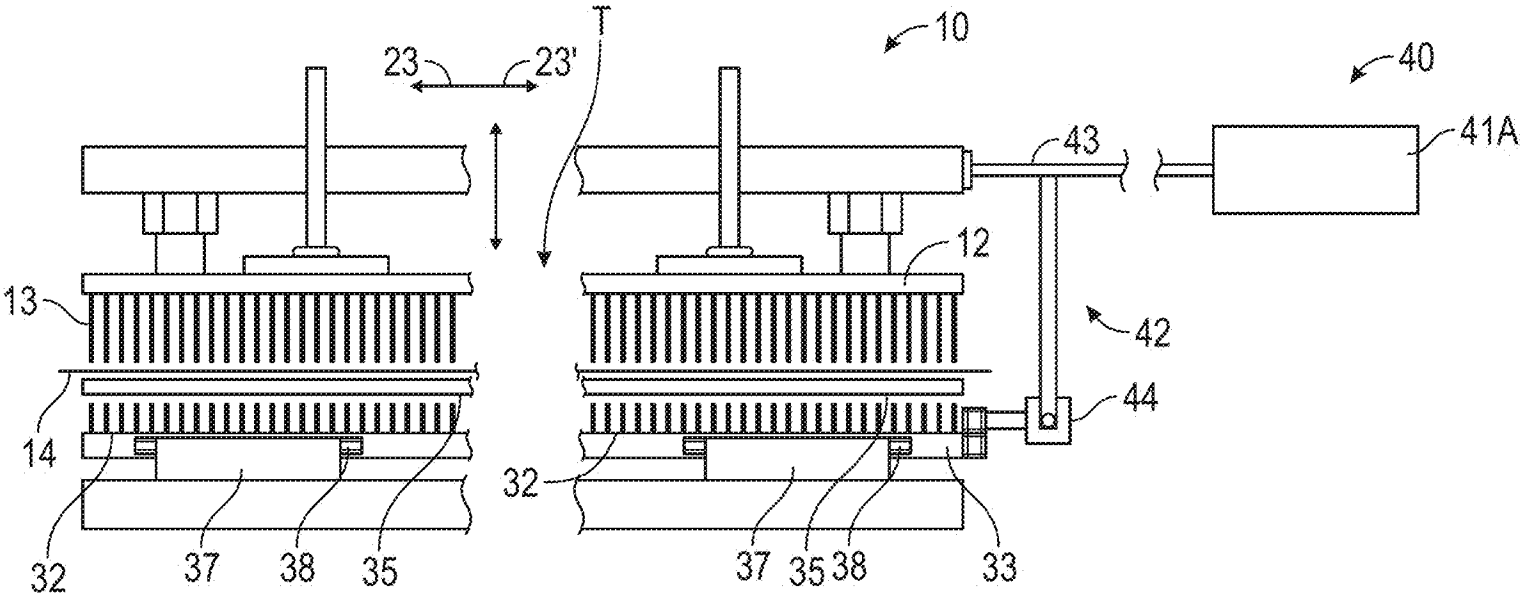

In other embodiments, such as illustrated in FIGS. 6 and 7A-7B, a single shift mechanism 40 can be provided for shifting both the needle bar and the gauge bar. In such an embodiment, as illustrated in FIGS. 7A-7B, a linkage assembly 42 can be provided for connecting the gauge bar to the needle bar so that the needle bar and gauge bar are shifted substantially in a synchronous motion with each other. Alternatively, in some embodiments, the linkage assembly can connect the gauge bar to an associated shift mechanism. For example, in an embodiment, the linkage assembly 42 can include a first linkage or connector 43 coupled to the needle bar and/or the shifter and to a second linkage connector 44 that is coupled to the gauge bar 33 such that the transverse shifting movement of the needle bar is translated mechanically to the gauge bar, which is thus moved by substantially a same corresponding incremental distance to maintain the gauge parts in a matched pitch relationship with the needles. In embodiments, the linkage assembly 42 can be configured to vary the movement of the gauge parts as needed so that the gauge parts can be moved in a second timing window while the needles are moved in a first timing window.

As shown in FIGS. 7A-7B, in some example embodiments, the first linkage or connectors 43 can include an arm or a bracket that can be oriented vertically, with a first end being coupled to the needle bar (e.g., being attached to an end of the needle bar, or to a connecting rod extending between the needle bar and the shift mechanism), and with a second end 43A that can be coupled to a first end 44A of the second linkage or connector 44. In embodiments, the second linkage or connector 44 can have a second end 44B that can be coupled to the gauge bar 33 (e.g., being attached to the gauge bar such as by one or more fasteners or being attached to a connecting part, such as an arm or bracket coupled to the gauge bar). In addition, as also indicated in FIG. 7A, in some embodiments, the second linkage or connector 44 could comprise or be coupled to a cylinder or other, similar actuator that can be configured to enable the gauge parts to be shifted in additional and/or different increments from the shifting of the needles.

The control system for the control operation of the shift mechanism or shift mechanisms 40 can move the needles and gauge parts in selected increments or steps that, in embodiments, can be based on a sewing gauge that is different from the machine or needle bar gauge. For example, using a $1/8^{th}$, $1/10^{th}$, $1/12^{th}$, or other gauge machine, the needles and gauge parts can be indexed or shifted in increments that are from a selected multiple or fraction of the gauge of the needle bar. For example, using a $1/10^{th}$ gauge tufting machine having a $1/10^{th}$ gauge needle bar with 10 needles per inch spaced at 0.10 inch apart, the needles and gauge parts can be shifted in increments of 0.02', 0.03', 0.04', 0.05', etc., so as to form tufted article with a $1/20^{th}$, $1/30^{th}$, $1/40^{th}$, or $1/50^{th}$ sewing gauge. Other sewing gauges, including $1/5^{th}$, 5/32nd, $1/16^{th}$, as well as non-uniform or non-standard sewing gauges, such as $1/7^{th}$ gauge, $1/11^{th}$ gauge, etc. also can be run using the same $1/10^{th}$ gauge tufting machine and needle bar, without requiring a change to the needle bar set-up.

In addition, in embodiments, the control system further can control the feeding of the backing material at an increased effective, actual or operable stitch rate that is increased in comparison to the designed fabric or pattern stitch rate sufficient to provide a desired density that can selectively be increased or enhanced over the designed density of the pattern being tufted as desired. For example, in embodiments, the actual stitch rate at which the backing is fed can be adjusted by the control system based upon the desired density and/or selected gauge at which the needles engage, and further in view of the designed fabric or pattern stitch rate and the number of colors or types of yarns in the pattern. For example, in embodiments, the actual stitch rate could equal the desired density divided by selected sewing gauge (e.g., $1/20^{th}$) and multiplied by a number of colors (e.g., 4) and further by a designed fabric or pattern stitch rate (e.g., 10 stitches per inch (spi)) to provide a resultant actual stitch rate of approximately 80 spi.

In addition, in other embodiments, the pattern can be selected to be tufted in non-uniform pitch or gauge that is not based upon a multiple or fraction of the needle bar or tufting machine gauge. By way of illustration, for example, utilizing a $1/10^{th}$ gauge bar, the needles 13 and gauge parts 32 could be shifted by approximately 0.090 inches, so as to form an $11^{th}$ gauge fabric tufted article. In some embodiments, where the tufted articles are formed with non-uniform sewing gauges, the color coverage may not match a projected virtual gauge for the pattern, and therefore the control system will be provided with programming configured to enable the control system select appropriate colors to ensure proper color coverage at the ends or edges of the pattern (e.g., to help ensure a width of the color coverage substantially matches the pattern as designed).

Figure 10:
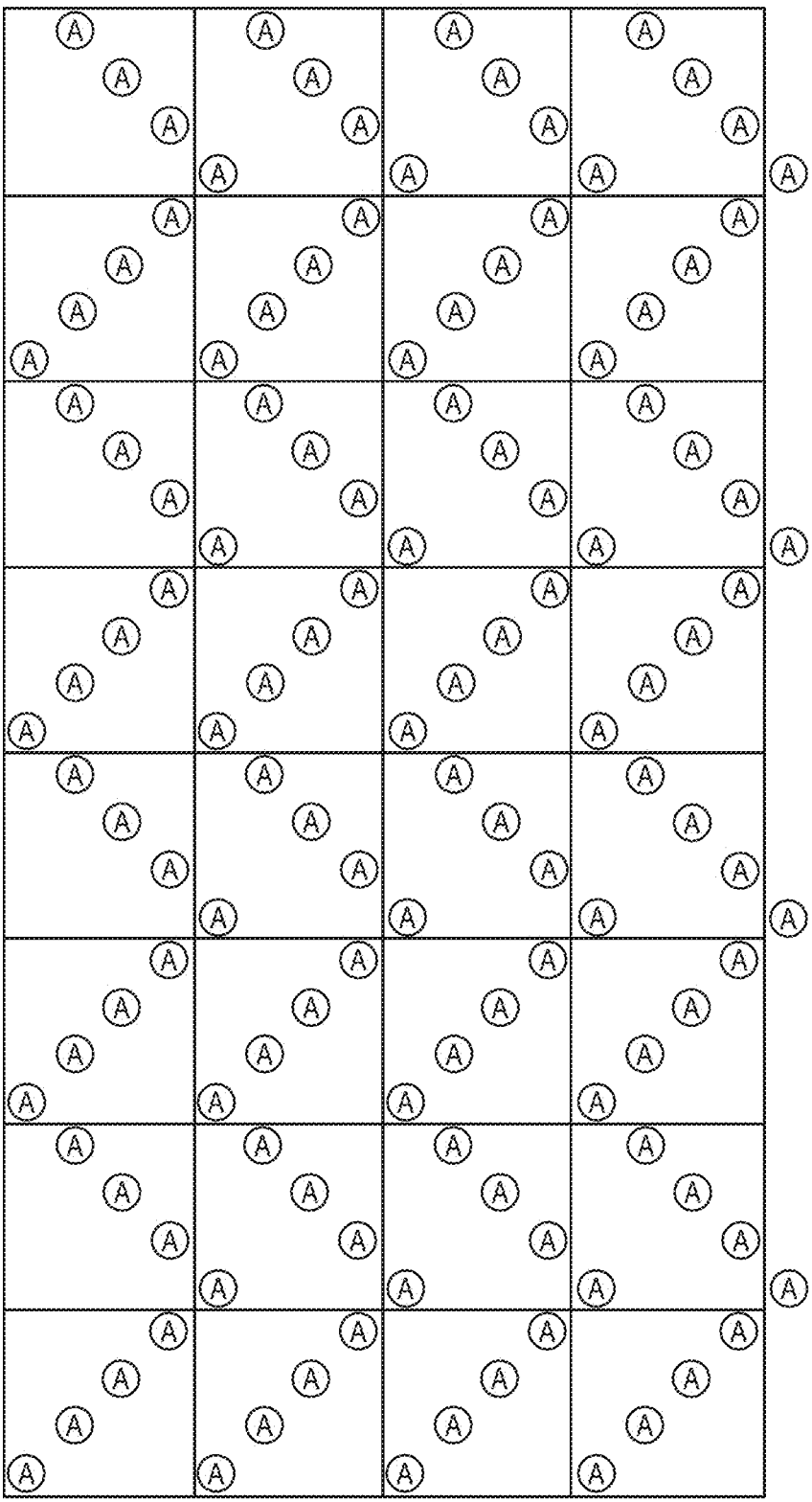
FIG. 10 illustrates an example embodiment of a stepping movement of one needle of a $1/10^{th}$ gauge tufting machine being indexed at $1/40^{th}$ sewing gauge increments.

For example, as illustrated in FIG. 10, where a non-traditional gauge fabric is to be tufted, for example, a $1/11^{th}$ gauge tufted article using a $1/10^{th}$ gauge needle bar and gauge bar, the pattern can be designed for one or more selected needles (e.g., based placement of one or more selected colors or types of yarns) and needles and gauge parts can be shifted in accordance with an $11^{th}$ gauge tufted article. The selected needle and/or adjacent needles may not always penetrate in a same or substantially same stitch location or pixel, and the control system can be provided with programming configured to enable the control system to decide and/or select an appropriate color or type of yarn that could be retained to render the design in the pattern.

As a result, in embodiments, the tufting machine can be set up using a substantially standard gauge, such as a $1/8^{th}$ gauge, $1/10^{th}$ gauge, $1/12^{th}$ gauge, etc., and can be operated to selectively change a sewing gauge in which the tufted articles are being formed. Thus, multiple different gauge tufted articles can be formed without having to change or modify the gauge of the needles and gauge parts. In embodiments, this can include the formation of much finer gauge fabrics that typically would require smaller or finer gauge needles and gauge parts, but which now can be substantially formed using a tufting machine having a single gauge setup.

Figure 8A:
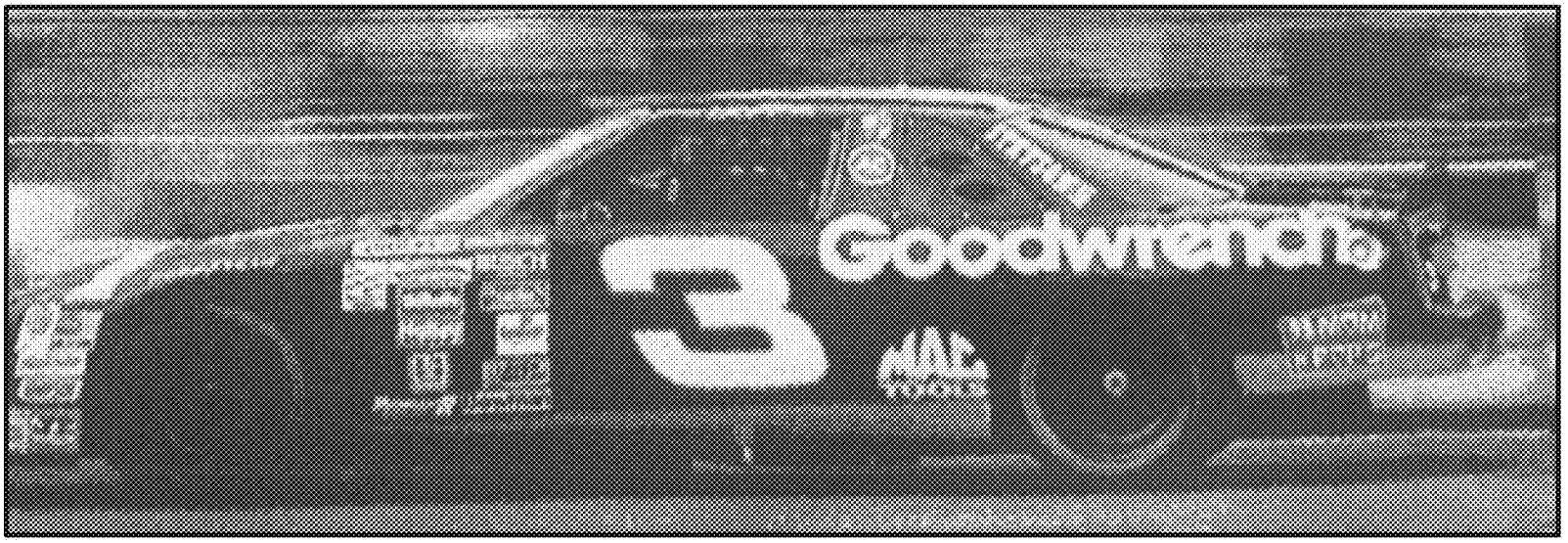
FIGS. 8A and 8B illustrate samples of tufted patterns, utilizing embodiments of the methods in accordance with the principles of the present disclosure.
Figure 8B:
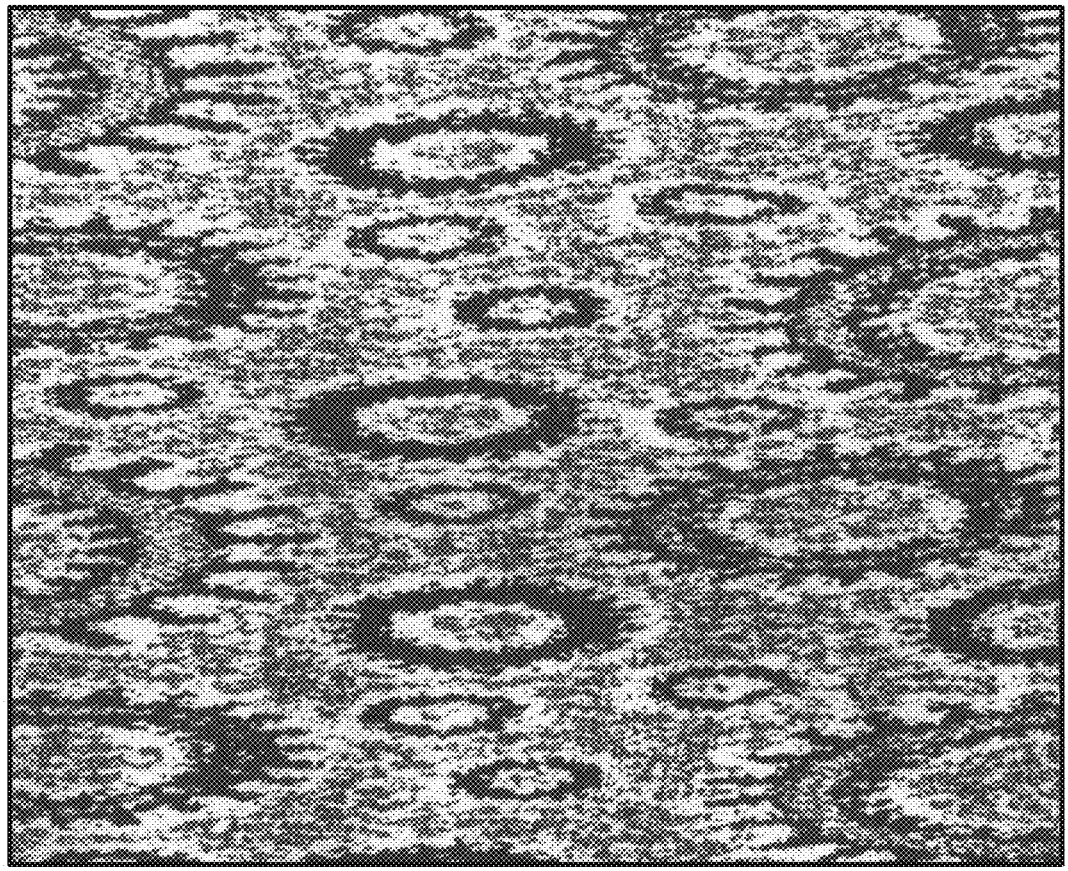

In addition, by utilizing control of the backing or cloth feed to feed the backing at an increased or operative stitch rate based upon a number of colors or types of yarns of the pattern (and in connection with the desired yarn feed, the selectable shifting of the needles and gauge parts at a variable sewing gauge), the density of the resultant tufted articles can be substantially varied (e.g., in embodiments, some increased). This can enable further enhanced resolution and clarity of the patterns being produced. For example, as shown in FIG. 8A, it becomes possible to reproduce images or designs, photos, or other images in a highly accurate fashion as a tufted article, such as a carpet.

As illustrated in FIGS. 1B-2B, the puller rolls 19 can be provided along upstream and downstream sides of the tufting zone and positioned along a path of travel of the yarns being fed from the yarn feed 18. The rotation of the puller rolls can be controlled by one or more servo motors 46, operated/controlled by the control system so as to ensure a substantially consistent feeding of the yarns to each needle. The feeding of each of the yarns by the yarn feed devices in turn can be controlled based upon a rotation of the main drive shaft so as to essentially match a rate of feed of the yarns from the yarn feed devices, the yarn feed to deliver a desired amount or length of yarn within portions of the revolution of the main drive shaft so as to further ensure substantially consistent yarn delivery to the needles by the puller rolls.

For example, in embodiments, the yarn feed devices 45 of the one or more yarn feed mechanisms 27 can be controlled by the control system so as to supply a total stitch length of a selected yarn (e.g., a length of yarn required for performing a tuft to a selected or desired length) within a portion of each stitch cycle or revolution of the main shaft of the tufting machine. In embodiments, different lengths or amounts of yarn making up a total stitch length of each selected yarn to be fed for forming a tuft of a desired pile height can be fed at a controlled (e.g., an increased or decreased) rate during different portions of the tufting cycle, or at different times based on the rotation or position of the main shaft (e.g., in embodiments, the yarn feed devices of the yarn feed system can be operated to feed different percentages or amounts of yarns in view of where the main shaft is in a revolution thereof, as opposed to feeding a substantially consistent amount of yarn during a revolution of the main drive shaft).

In embodiments, the puller rolls can be driven at a selected rate and in time with the feed rolls of the yarn feed (e.g., generally being driven in synch with the feeding of selected yarns by individual yarn feed devices or the feeding or multiple yarns by a single yarn feed roll), to help prevent the yarns from wrapping about the feed rolls. In some embodiments, the puller rolls can further be driven at a rate and/or at a combination of a rate and position with respect to the rotation of main drive shaft such that they are primarily feeding in sync with the feeding of the yarns in different amounts or percentages at within different portions of the rotation of the main drive shaft.

By way of example only, if a yarn length or amount to be fed for selected colors of yarns is about 4" during an initial 120° of the rotation of the main drive shaft, the puller rolls could be operated to feed a little more than 4" of the selected yarns during this initial 120° of the rotation of the main drive shaft. During the remaining 240°, the puller rolls and/or the feed rolls of the yarn feed devices for the selected yarns could be used to slow down and/or speed back up the feeding of such selected yarns to the needles as needed (to help minimize extra pull on the yarn). Still further, in embodiments, the yarn feed rates for forming a first and/or last stitch of a selected color or type of yarn can be adjusted in view of an upcoming tuft row color change in the pattern design being formed.

Such control of the delivery of the yarns by the yarn feed can provide for delivery of the yarns to the puller rolls provided along the front and rear sides of the tufting machine at a rate selected and controlled to substantially maintain consistency of the feeding of the yarns to the needles. In embodiments, the puller rolls can be operated to rotate at a different rate than the yarn feed rolls. For example, in embodiments, the puller rolls can be driven at a rate that is substantially in sync with the feeding of the yarns and that is sufficient to generally keep the yarns pulled off of the yarn feed rolls to minimize wrapping of the yarns around the yarn feed rolls.

Figure 5:
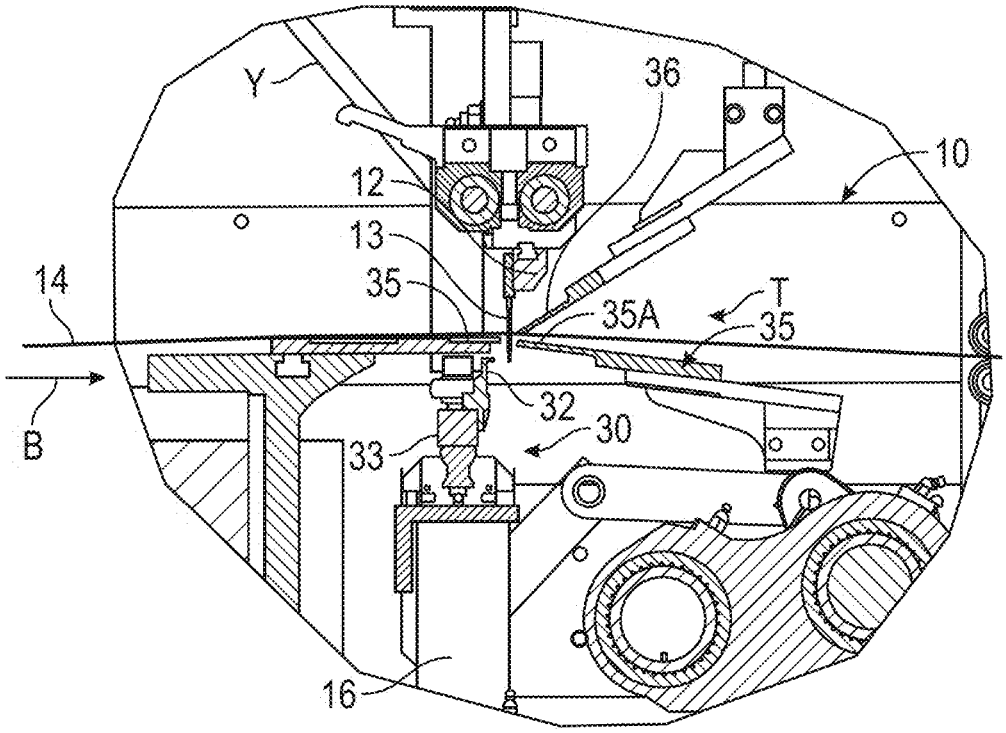
FIG. 5 illustrates a section of the tufting machine as illustrated in FIGS. 4A-4B, showing an embodiments of the tufting zone, the presser foot, and backing support plates of a tufting machine configured for forming selectable gauge tufted articles in accordance with the principles of the present disclosure.

As illustrated in FIG. 5, the backing support plates 35, in embodiments, will be mounted on the upstream and downstream sides of the tufting zone T, and will include substantially straight or flat forward edges 35A, without including reeds, fingers or wires between which the needles will pass during a tufting cycle, as used in conventional tufting machines. The backing support plates generally will be spaced apart by a distance sufficient to enable passage of the needles therebetween, and without interfering with the shifting movement of the needles transversely across the tufting zone in different sewing gauges, and which will provide support for the backing 14 as it passes thereover, without the backing being pulled between the front edges of the backing support plates.

In embodiments, one or more of the backing support plates further can comprise or can be coupled to an adjustable bed rail, which can be adjusted by the control system as needed to adjust the position of the backing, such as for forming tufts of varying selected pile heights. In addition, a presser foot 36 generally can be provided along the upstream side of the tufting zone, and can be engageable with the backing to help maintain a position of the backing during movement of the needles into and out of the backing for insertion of the yarns and formation of tufts in the backing.

As additionally illustrated in FIGS. 1B-2B and 6, the yarn feed 18 can include one or more pattern yarn feed mechanisms or attachments 27 can be mounted to the frame 16 of the tufting machine 10 for controlling the feeding of the yarns Y to each of the needles during operation of the tufting machine. For example, a series of different type or color yarns can be fed in a selected thread-up sequence or series (e.g., ABCD) to each of the needles, with the thread-up sequences being determined or selected based upon a pattern being run. There are a variety of yarn feed attachments that can be utilized with the stitch distribution control system of the present disclosure for controlling the feeding of the different yarns Y to various ones of the needles 13.

In embodiments, the yarn feed mechanisms 27 (FIG. 4A) can comprise various types of yarn feed drive mechanisms such as roll or scroll pattern attachments having a series of rolls extending at least partially along the tufting machine and driven by motors under direction of the control system for controlling the feeding of the yarns across the tufting machine to form pattern repeats, multiple pile heights, and/or other texture effects across the width of the backing material. In various embodiments, such yarn feed mechanisms or attachments can include roll, scroll, single-end, double-end, and/or other types of pattern yarn feed attachments.

Figure 1B:
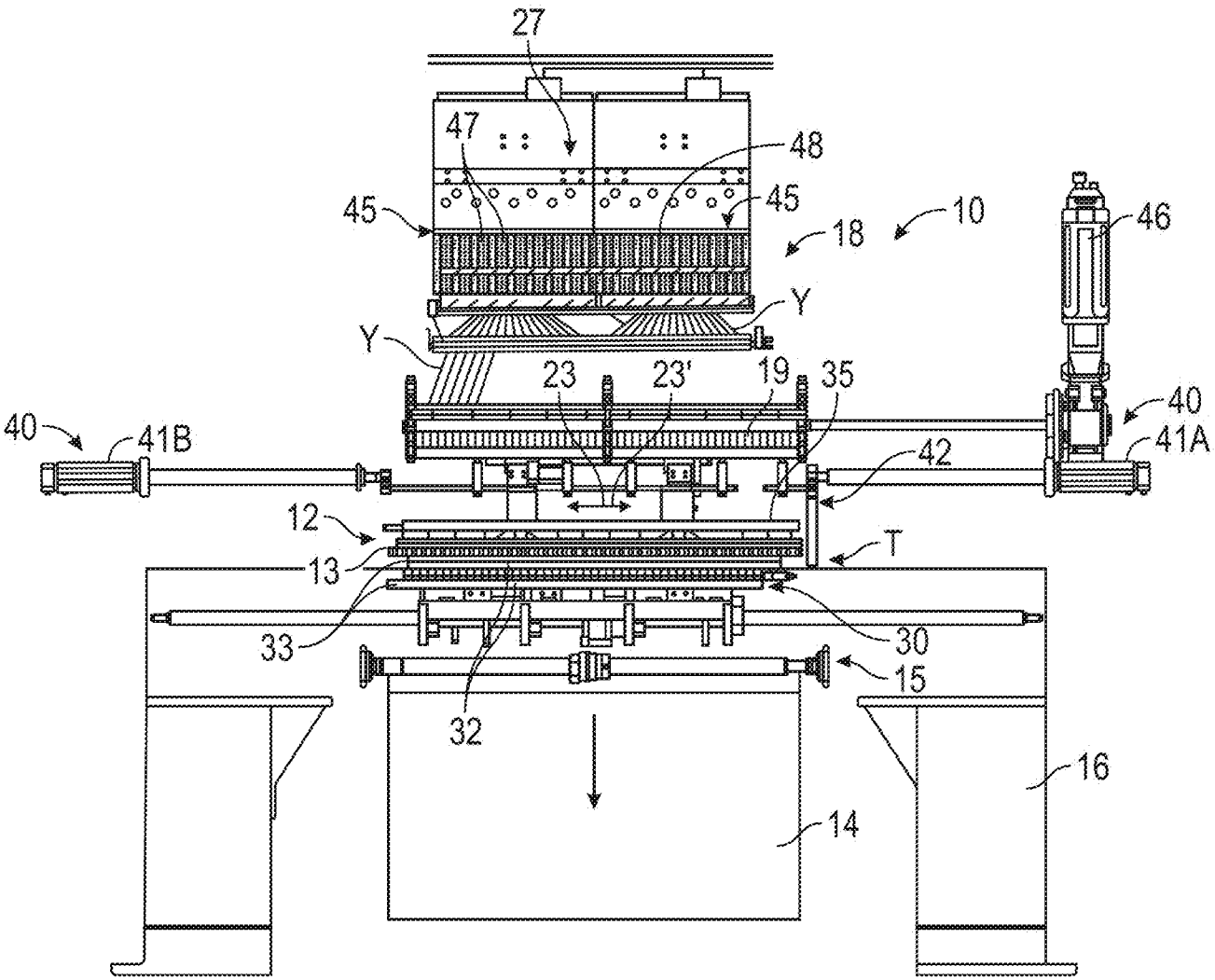
Figure 2A:
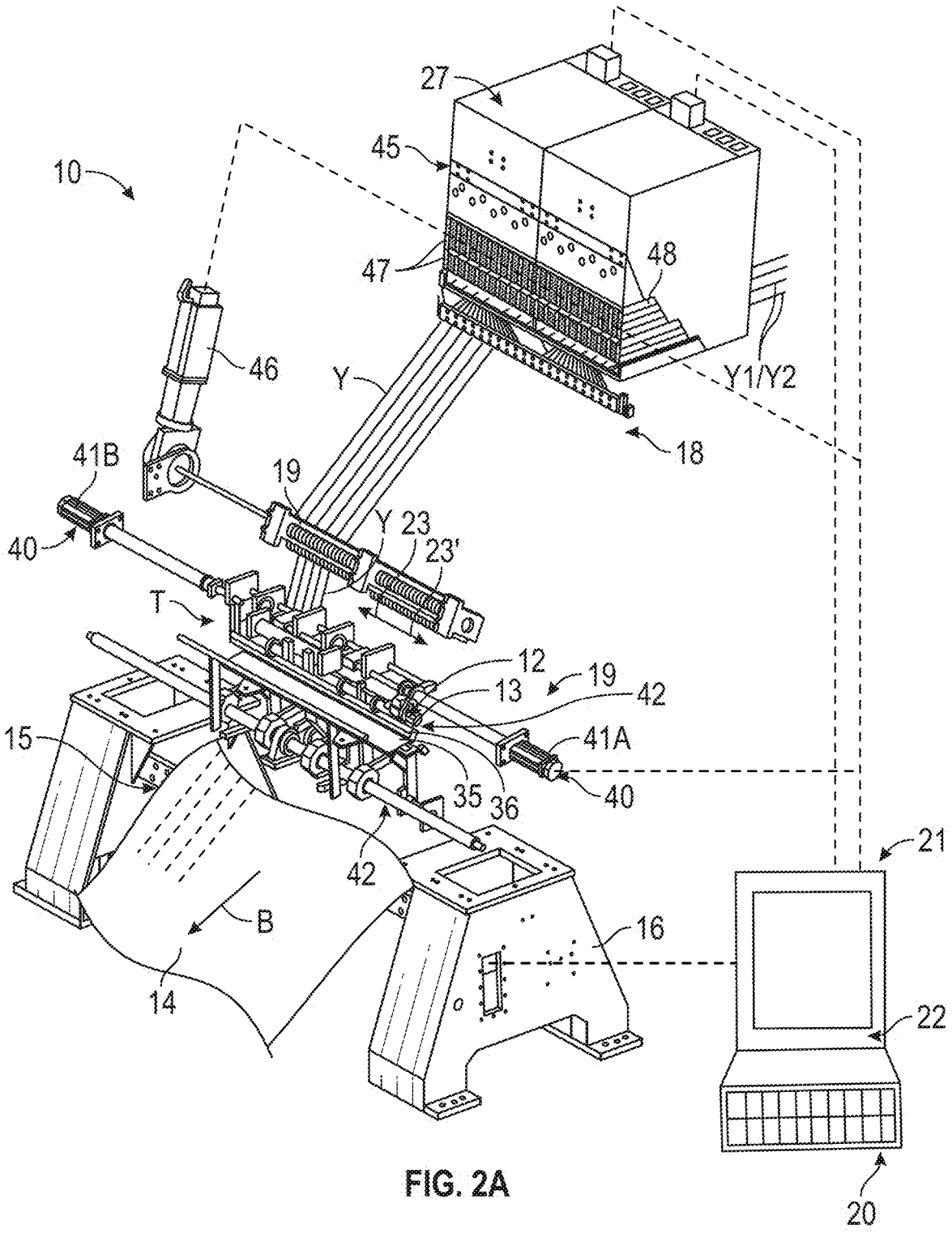
FIGS. 2A and 2B are perspective views illustrating an embodiment of a tufting machine configured for forming selectable gauge tufted articles in accordance with the principles of the present disclosure.
Figure 2B:
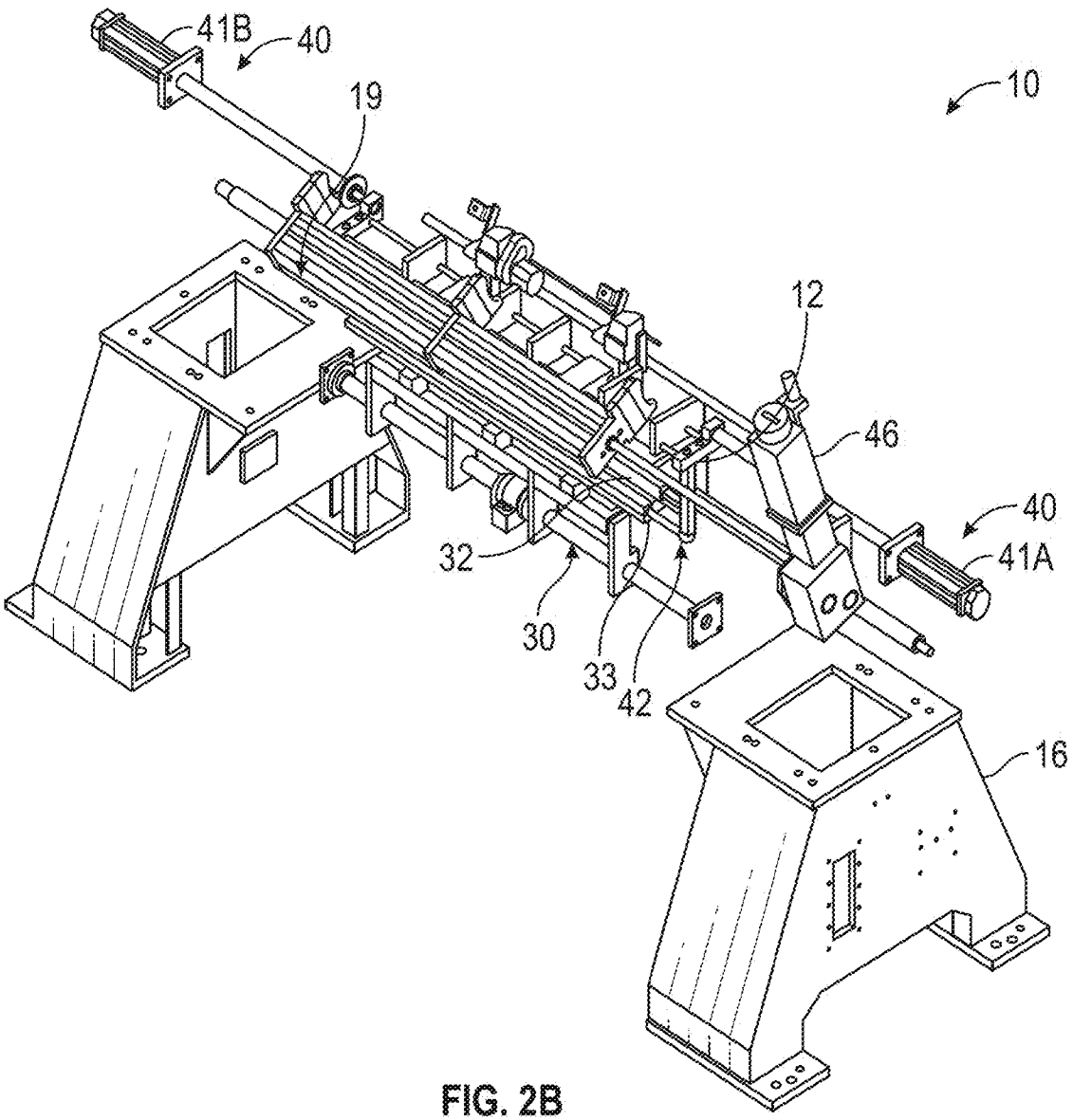
Figure 3:
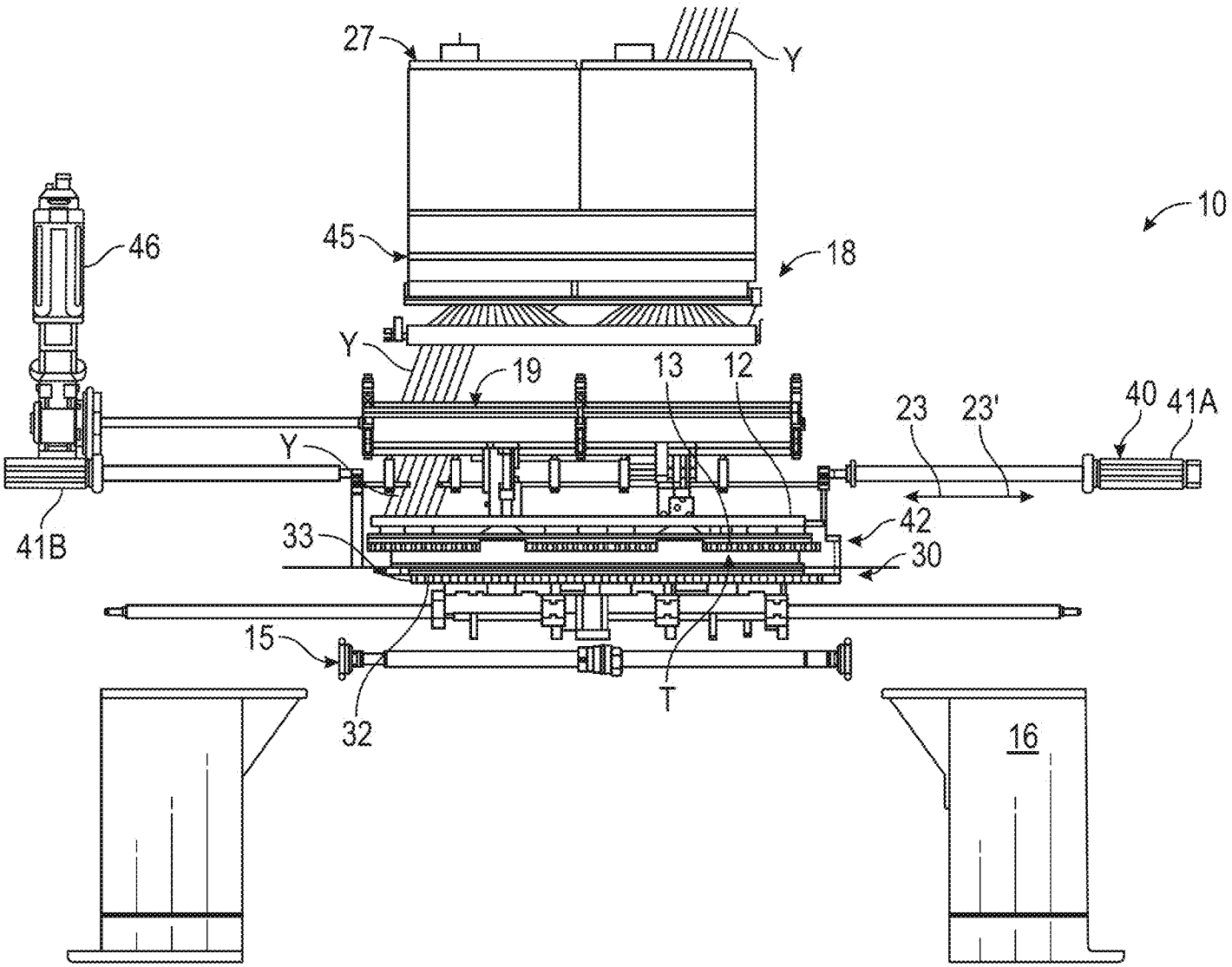
FIG. 3 is a side elevational view of the front or upstream side of the tufting machine of FIGS. 1A-2B.

For example, in some configurations of the tufting machine, such as generally illustrated FIGS. 1B, 2A and 4A, the yarn feed mechanisms 27 can include pattern yarn feed attachments that have a plurality of yarn feed devices 45, each of which can include a motor 47 and at least one feed roll 48 (and in embodiments, two or three feed rolls), configured for controlling the feeding of specific sets of repeats of yarns to selected needles, including the use of individual yarn feed rolls or devices 45 for controlling the feeding of single yarns (or ends) or pairs (or more) of yarns to each of the needles.

In some embodiments, the yarn feed devices can be arranged in sets or groups that can be removably mounted within frames of a housing, thus defining modules that can be removably received within the housing of a yarn feed unit and which can include a plurality of yarn feed roll assemblies and drive motors. An example of a pattern yarn feed attachment or yarn feed mechanisms can include an Infinity™ and/or Infinity IIE™ yarn feed system as manufactured by Card-Monroe Corp.

It will, however, be understood that while a single-or double-end type yarn feed mechanism 27 is shown in the FIGS., the pattern yarn feed attachments or mechanisms utilized to control the yarn feed can include a variety of yarn feed controls and are not limited to solely single-or double-end yarn feed controls. The tufting machine of the present disclosure is able to utilize scroll, roll, and/or similar pattern yarn feed attachments or mechanisms, and/or various combinations thereof, to feed the yarns to the needles while still enabling enhanced accuracy and placement of selected tufts of yarns according to the pattern being formed, and enhanced densities of such patterns being formed.

Still further, the control system can perform yarn feed compensation and/or yarn feed modeling to help control and reduce or minimize the amounts of non-retained/non-appearing yarns having to be left floating on the back side of the backing. In addition, in some embodiments, the control system can adjust the sewing gauge to provide positive stich placement. In addition, in embodiments, such as where the gauge parts can include combinations of loop pile loopers, level cut loopers, hooks, etc., to form combinations of cut and loop pile tufts, the control system can include programming to adjust the timing of the indexing or shifting.

In embodiments, the yarn feed attachment can be controlled to selectively feed the yarns to their respective needles, to enable control of the pile height at which the tufts are formed. In addition, the surface or face yarns or tufts that are to appear on the face of the tufted article can be controlled so as to be fed in amounts sufficient to form such desired cut/loop tufts at desired or prescribed pile heights, while the non-appearing yarns that are to be hidden in particular color and/or texture fields of the pattern can be pulled low or out of the backing to an extent sufficient to avoid creating an undesired space or gap between the retained or face yarns, while also not interfering with the placement of selected yarns at the stitch locations. In one embodiment, each color or type yarn that can be placed/tufted at each pixel or stitch location generally can be presented to such pixel or stitch location for tufting, with only the yarn(s) to be shown or appearing at the pixel or stitch location being retained and formed at a desired pile height. Thus, for a 4 color pattern, for example, each of the 4 color yarns A, B, C and D that can be tufted at a particular pixel or location can be presented to such pixel with only the selected yarn or yarns of the pattern, e.g., the "A" yarn, being retained, while the remaining, non-selected yarns, B-D are presented and can be pulled back and/or removed from the pattern pixels or stitch locations.

Accordingly, any time a yarn is presented to a pixel or stitch location, if the yarn is selected to be retained or appear in the pixel or stitch location, the yarn feed 27 can be controlled to feed an amount of yarn sufficient to form a tuft of the yarn at the pixel or stitch location. If the yarn presented is not to be retained or appear at the pixel or stitch location, it can be pulled back and/or removed. If no yarns are selected for insertion at a particular pixel or stitch location, the needle bar further can be shifted to jump or otherwise skip or bypass presentation of the needles to that pixel or stitch location.

As the needle bars are reciprocated, the needles 13 are moved vertically between a raised position out of engagement with the backing 14 passing through the tufting zone and a lowered, engaging position extending through the backing material. A series of gauge parts 32 (FIGS. 5 and 7), which can include loopers, hooks, level cut loopers or hooks, cut/loop clips, or other gauge parts, are mounted beneath a bed plate of the tufting machine and are moveable toward and away from the needles of the needle bar and gauge bar to accommodate for movement of knives, etc. The gauge parts generally will be configured to pick up loops of yarns from the needles for the formation of tufts of yarn within the backing material. For example, as shown in FIG. 5, in some embodiments, the gauge parts can include loop pile loopers configured to form loop pile tufts; while in various other embodiments, cut pile hooks and knives can be used to form cut pile tufts, and, in still other embodiments, level cut loopers and/or cut/loop clips configured to form cut and loop pile tufts, and other types of gauge parts can be used.

In embodiments of a method of operation of the tufting machine 10, the controller 21 of the control system 20 generally can be configured (e.g., include programming) to monitor feedback from and control various operative or drive elements of the tufting machine, such as for monitoring and receiving feedback from a main shaft sensor (e.g. in embodiments, an encoder) for controlling the one or more main shaft drive motors so as to control the reciprocation of the needles; for monitoring and controlling one or more drive motors for the backing feed rolls (e.g. to control the operative, effective or actual stitch rate or backing feed rate at which the backing is fed through the tufting zone); and for monitoring and controlling feeding of the yarns to each needle by the yarn feed mechanism 27. In embodiments, one or more sensors also can be mounted to the frame 16 in a position to provide further position feedback regarding the needles. In addition, for shiftable needle bar tufting machines, the controller 21 also can include programming or receive/retrieve instructions configured for monitoring and controlling the operation of one or more needle bar shift mechanism(s) 40 (FIG. 1B) controlling the shifting of both the needle bar and the gauge bar to maintain the needles and gauge parts in an aligned, pitch relationship, according to pattern instructions for a pattern being tufted.

In embodiments, the control system may receive and store pattern instructions or information for a series of different carpet patterns. Such pattern instructions can be stored as a data file in a memory at the controller itself for recall by an operator, or can be downloaded or otherwise input into the controller by the means of a floppy disk or other recording medium, direct input by an operator at the controller, or from a network server via network connection. In addition, the controller can receive inputs directly from or through a network connection from a design center. Such a design center can include a separate or stand-alone design center or work-station computer with monitor and user input, such as a keyboard, drawing tablet, mouse, etc., through which an operator can design and create various tufted carpet patterns. This design center also can be located with or at adjacent the tufting machine or can be remote from the tufting machine.

A pattern file and/or possibly graphic representations of a desired carpet pattern can be provided to the control system, which pattern file can include instructions and/or calculations of various parameters required for tufting such a carpet pattern at the tufting machine, including calculating yarn feed rates, pile heights, backing feed or stitch rate, and other required parameters for tufting the pattern. These pattern files then can be downloaded or transferred to the controller, to a USB, disk, or similar recording medium, or can be stored in memory either at the design center or on a network server for later transfer and/or downloading to the controller.

In embodiments, the needles and gauge parts can be substantially precisely shifted (in incremental distances to form different gauge tufted articles. This provides the tufting machine with great versatility by enabling it to operate with a common, initial selected gauge (e.g., $1/8^{th}$, $1/10^{th}$, etc.), while being capable of being used to run a variety of different selectable sewing gauges without reconstructing or rearranging the gauge parts and needles.

For instance, a $1/10^{th}$ gauge tufting machine can be used to form tufted articles with selected sewing gauges of $1/5^{th}$, $1/6^{th}$, $1/7^{th}$, 5/32nd, $1/8^{th}$, $1/9^{th}$, $1/10^{th}$, $1/11^{th}$, $1/12^{th}$, $1/16^{th}$, $1/20^{th}$, $1/30^{th}$, $1/40^{th}$, $1/50^{th}$, and other gauges. This can also enable the density of the tufted article to be enhanced. For example, a $1/10^{th}$ gauge machine will most commonly tuft at about 10 stitches per inch with a resulting 100 stitches being placed in a square inch of backing (e.g., resulting in a substantially square pattern density of 100 $in^2$). However, by increasing the stitch rate (e.g., running an operational, effective or actual stitch rate that, in embodiments, can be based on the number of colors or types of yarns times a designed or desired fabric or pattern stitch rate), the density of the tufts of the resultant tufted article can be increased over a square construction of the pattern, but without excess tufts of yarns that are not to be visible in the pattern being retained as fully formed high or low tufts (e.g., the yarns can be pulled back so as to substantially remove the yarns from the face of the backing and not interfere with the placement of a selected color or type of yarn at a corresponding stitch location, while maintaining the yarns in engagement with the backing).

In cases where the stitch rate is being increased by a multiple of the gauge of the backing shifter and reciprocating needle plate equipped tufting machine (e.g., in embodiments, based on a multiple of the gauge spacing of the needles or the gauge parts), there may or may not be a substantially perfect pattern alignment (e.g., a substantially exact longitudinal alignment of tufts) as there may be some rounding adjustments in changing stitch densities and locations. In embodiments, the failure to align in exact longitudinal rows may be perceived as an advantage in some tufting applications. For instance, solid color shifting is used when manufacturing solid color carpets to break up any streaks or irregularities in the yarns that might otherwise be noticeable. By shifting the needles and gauge parts together, a positive stitch placement effect can be provided with substantially minimal shift distances. For example, shift distances or increments of less than 0.10-0.020 inches can be used. The smaller incremental shifts can enable finer gauge tufted articles to be formed (including at gauges substantially less than can be produced using traditional finer gauge tufting machines with smaller gauge parts and needles) while still enabling increased machine speeds and production rates, and, in embodiments, can reduce the amount of yarn on the backstitches.

FIGS. 8A-9B show examples of various tufted articles produced using the tufting machine and methods of the present disclosure. FIGS. 8A and 8B show examples of patterned carpets with enhanced resolution at non-standard gauges.

Figure 9A:
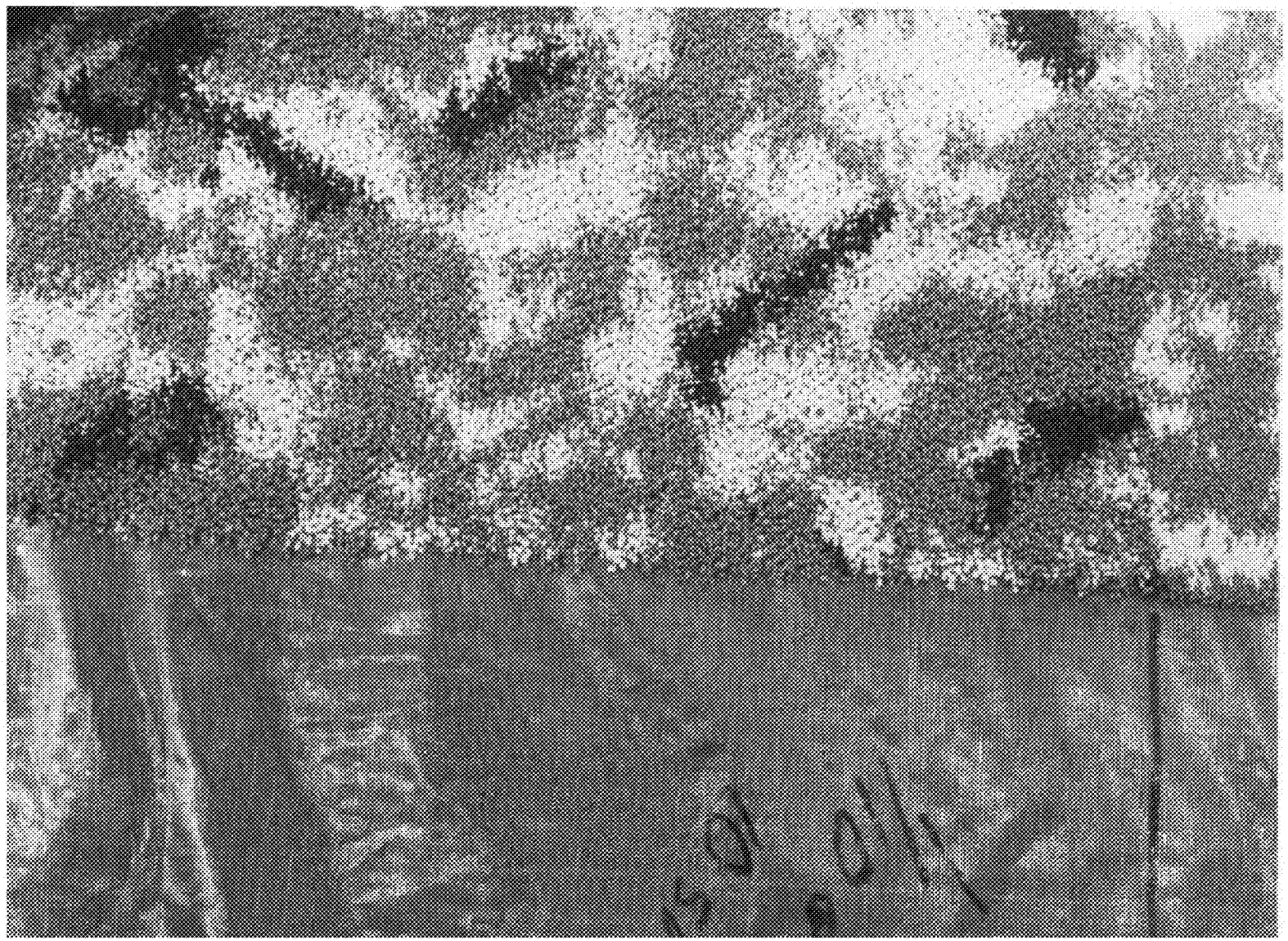
FIGS. 9A and 9B illustrate sample tufted carpets formed using a method of tufting wherein carpets are formed with a selectable variable density that can be increased or decreased without changing a gauge spacing of the needles of the tufting machine in accordance with the principles of the present disclosure.
Figure 9B:
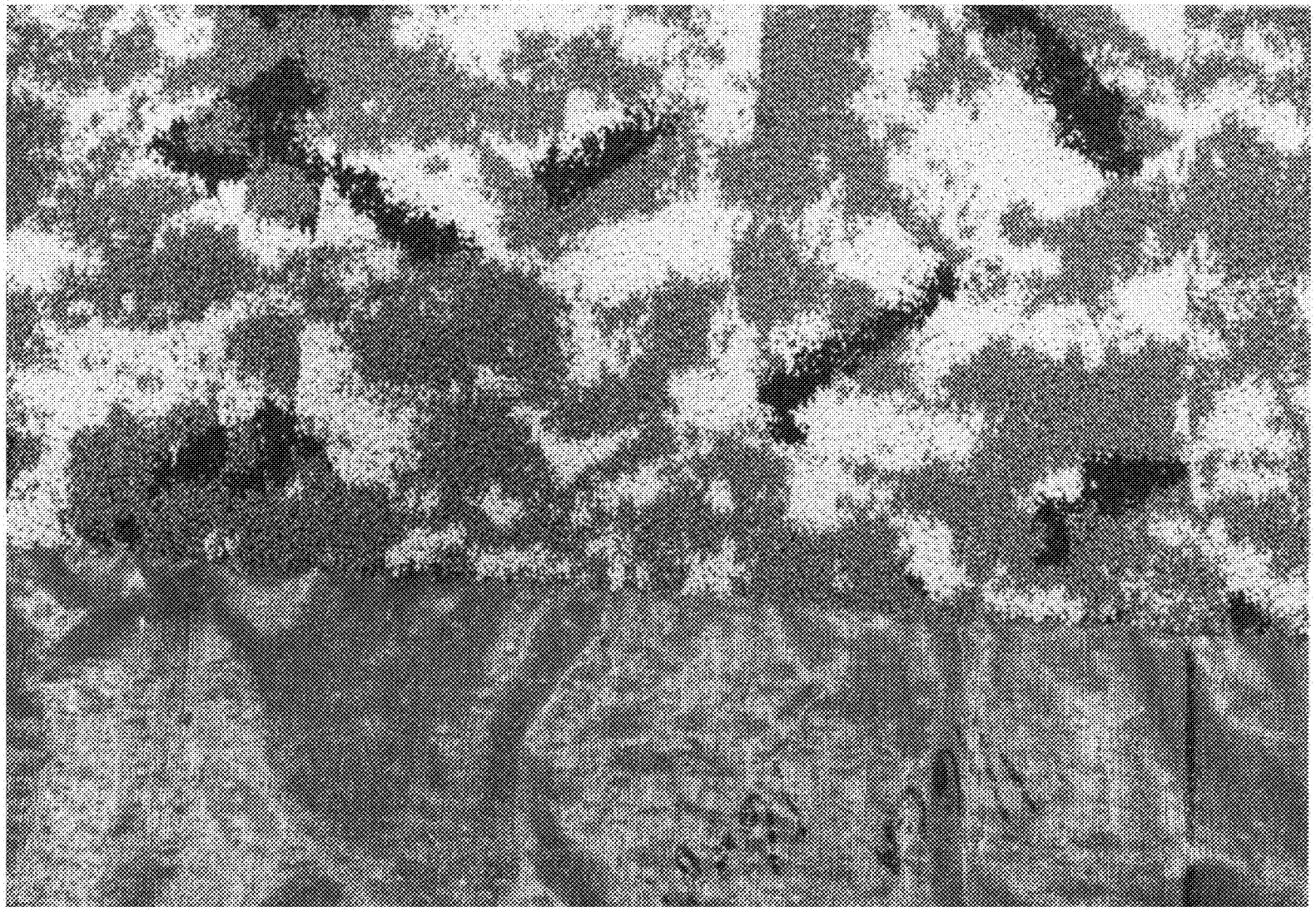

FIGS. 9A-9B show a single pattern tufted at different gauges on the same tufting machine. The tufting machine was set-up as a $1/10^{th}$ gauge tufting machine with the needles and gauge parts arranged at a gauge spacing of $1/10^{th}$ inch. FIG. 9A shows the tufted pattern run at 10 stitches per inch and with a gauge of $1/10^{th}$, resulting in a generally square construction such that the resultant density of the tufted article (e.g., 10 stitches per inch×10 needles per inch=100 stitches per square inch) that is substantially matched the designed density for the pattern. FIG. 9B shows the same pattern run using the same tufting machine set-up, but with the needles and the gauge parts being shifted together at shift increments resulting in the tufted article being formed at a gauge of $1/6^{th}$ inch using the same tufting machine setup and with the pattern of the tufted article provided with a further enhanced resolution.

FIG. 10 illustrates an example shift pattern or movement at which a needle can be moved at a selected multiple of the gauge of the needle bar, showing the presentation of a color of yarn (designated by "A") to each of a plurality of stitch locations of a pattern. In the example of FIG. 10, the needle bar is a $1/10^{th}$ gauge needle bar, e.g., with 10 needles per inch spaced apart by 0.10 inch, and with the pattern gauge being selected to be a $1/40^{th}$ gauge. It will be understood that while this example is showing movement of 1 needle carrying 1 color or type of yarn for purposes of illustration only, in some embodiments, the needle bar can be threaded with multiple different colors or types of yarns and various thread-up sequences (e.g., 2, 3, 4, or more colors using an AB, ABC, ABCD, or other varying thread-up sequences).

As illustrated, when running the pattern at a pattern gauge of $1/40^{th}$ using a $1/10^{th}$ gauge needle and gauge part set-up, the needle carrying the A yarn can be indexed or stepped in increments of 0.025 inch. As the backing is moved by 0.10 inches in the longitudinal direction (e.g., being controlled to run at an actual stitch rate that is greater than the desired or designed fabric or pattern stitch rate of the pattern being tufted) the needle carrying the A yarn can be moved laterally approximately 0.075 inch. This generally will result in a change in density of the resultant tufted pattern, with the A yarn being presented to each stitch location approximately 4 times, though in some instances, the A yarn can be presented to a stitch location fewer or greater times and in different locations as shown in FIG. 10. In addition, the actual or operative, effective stitch rate at which the backing is moved can be determined based on the selected gauge times a number of colors of the pattern, further multiplied by the designed pattern stitch rate to enable presentation of each of the different colors to each stitch location, with the selected colors of yarns being retained, and with the resultant density of the tufted article being substantially increased over the designed or desired density of the pattern.

The present disclosure has been described herein in terms of examples that illustrate principles and aspects of the present disclosure. The skilled artisan will understand, however, that the figures, detailed description, and embodiments, while indicating specific embodiments of the disclosure, are given by way of illustration only and are not meant to be limiting; and that the embodiments described herein are exemplary only and are not limiting, and that a wide gamut of additions, deletions, alterations, and modifications, both subtle and gross, may be made to the presented examples without departing from the spirit and scope of the present disclosure. All such modifications which do not depart from the spirit of the disclosure are intended to be included within the scope of any of the aspects and/or claims provided by the present disclosure.

The invention claimed is:

1. A tufting machine, comprising:

at least one needle bar having a series of needles arranged therealong at a first spacing;

a yarn feed mechanism feeding yarns to the series of needles;

a series of gauge parts configured to pick-up yarns carried by the series of needles;

wherein the gauge parts of the series of gauge parts are arranged along at least one gauge bar at a second spacing;

one or more shift mechanisms configured to shift the at least one needle bar and the at least one gauge bar in a transverse direction with respect to a backing moving through the tufting machine; and a control system including programming configured for controlling feeding of the yarns by the yarn feed mechanism to the series of needles to form tufts of selected yarns picked up from selected needles by corresponding gauge parts at a selected pile height, and configured for controlling shifting of the at least one needle bar and the at least one gauge bar transversely with respect to the backing in shift increments that are less than or greater than the first spacing.

2. The tufting machine of claim 1, wherein the second spacing at which the series of gauge parts are arranged along the at least one gauge bar is substantially equal to the first spacing of the series of needles along the at least one needle bar.

3. The tufting machine of claim 1, wherein at least some of the gauge parts of the series of gauge parts are mounted in a plurality of modules; and wherein the modules are releasably secured to the at least one gauge bar.

4. The tufting machine of claim 1, wherein the control system further comprises programming configured for coordinating shifting of the at least one needle bar by the one or more the shift mechanisms and feeding of the backing with control of the yarn feed mechanism so as to present a series of yarns to selected stitch locations along the backing as the backing is moved at an actual stitch rate such that an increased number of tufts per inch can be formed in the backing, and to enable non-selected yarns of the series of yarns presented to be pulled back not interfere with a placement of the selected yarns at a corresponding stitch location.

5. The tufting machine of claim 1, wherein the gauge parts comprise level cut loop loopers, cut pile hooks, and/or combinations thereof.

6. The tufting machine of claim 1, wherein the yarn feed mechanism comprises at least one of a scroll, roll, single end or double end yarn feed pattern attachment.

7. The tufting machine of claim 1, wherein the control system further includes programming configured to control shifting of the at least one needle bar and the at least one gauge bar in non-uniform increments that are based on a multiple of the first spacing.

8. The tufting machine of claim 1, wherein the control system further includes programming configured to control shifting of the at least one needle bar and the at least one gauge bar in non-uniform increments that are not based on a multiple of the first spacing.

9. A method of forming a patterned tufted article having a designed pattern stitch rate and a designed pattern density, comprising:

moving a backing through a tufting machine; feeding a plurality of yarns to a plurality of needles as the needles are reciprocated into and out of a backing moving therebelow;

picking loops of yarns from the plurality of needles with a plurality of gauge parts;

shifting the plurality of needles and the plurality of gauge parts transversely with respect to a direction of movement of the backing;

wherein the plurality of needles and the plurality of gauge parts are shifted together by approximately a same distance so as to maintain the plurality of needles and the plurality of gauge parts in a substantially pitched relationship;

presenting one or more yarns of the plurality of varns to one or more stitch locations along the backing according to a pattern of the patterned tufted article being formed;

if a yarn is selected to be retained at the one or more stitch locations, controlling feeding of the yarn selected to be retained so as to retain a tuft of the yarn selected to be retained, and if a yarn is not selected to be retained, controlling feeding of the yarn not selected to be retained so as to pull back the yarn not selected to be retained to an extent that the yarn does not interfere with formation of a tuft of the yarn selected to be retained at the one or more stitch locations; and wherein moving the backing through the tufting machine comprises feeding the backing at an actual stitch rate approximately equivalent to a fabric stitch rate for the pattern increased by a selected amount.

10. The method of claim 9, wherein the plurality of yarns comprise different color or type yams; and further comprising:

threading the plurality of needles with the different color or type yarns in a selected sequence;

wherein the needles of the plurality of needles are positioned at a first spacing along at least one needle bar, and the gauge parts of the plurality of gauge parts are mounted along at least one gauge bar at a second spacing;

moving the backing through a tufting zone at the actual stitch rate; wherein the actual stitch rate is at least two times the designed pattern stitch rate for the patterned tufted article;

shifting the at least one needle bar and the at least one gauge bar transversely with respect to the backing sufficient to present a series of the different color or type yarns to the one or more stitch locations along the backing; and wherein the at least one needle bar and the at least one gauge bar are shifted by a selected shift distance so as to maintain the needles of the plurality of needles and the gauge parts of the plurality of gauge parts in a pitch relationship.

11. The method of claim 10, wherein the selected shift distance is user selectable and is less than the first and second spacings.

12. The method of claim 9, wherein the patterned tufted article is formed with a selected density that is greater than the designed pattern density.

13. The method of claim 9, further comprising controlling feeding of the series of different color or type yarns presented to the one or more stitch locations, and retaining at least one selected yarn of the series of different color or type yams presented at the one or more stitch locations so as to form tufts of the selected yarns at the one or more stitch locations, with remaining ones of the series of different color or type yarns presented at the one or more stitch locations being at least partially removed from the backing.

14. A tufting machine, comprising:

a backing feed configured to feed a backing along a path of travel through the tufting machine;

at least one needle bar having needles positioned therealong;

a yarn feed mechanism configured to feed yarns to the needles;

at least one gauge bar having gauge parts positioned therealong configured to pick-up the yarns from the needles;

one or more shift mechanisms configured to shift the at least one needle bar and the at least one gauge bar transversely with respect to the path of travel of the backing; and a control system including programming configured for controlling the one or more shift mechanisms to shift the at least one needle bar and the at least one gauge bar in substantially transversely across the backing in shift increments having a length less than or equal to a gauge spacing between the needles along the at least one needle bar so as to present an increased number of the yarns to each of a plurality of stitch locations, and configured for controlling feeding of selected yarns by the yarn feed mechanism to at least a portion of the needles such that the selected yarns picked up from the needles by the gauge parts; and whercin patterned tufted carpets are formed having a resultant pattern density that is greater than a designed density of a pattern as designed.

15. The tufting machine of claim 14, wherein the control system further comprises programing configured to control feeding of the backing through the tufting machine at an actual stitch rate determined by the designed density of the pattern divided by a length of the shift increments at which the at least one needle bar and the at least one gauge bar are shifted, multiplied by a number of colors of yarns of the pattern and by a pattern stitch rate of the pattern as designed.

16. The tufting machine of claim 14, wherein the control system further includes programming configured to control shifting of the at least one needle bar and the at least one gauge bar in non-uniform increments that are based on a multiple of the gauge spacing between the needles.

17. The tufting machine of claim 14, wherein the control system further includes programming configured to control shifting of the at least one needle bar and the at least one gauge bar in non-uniform increments that are not based on a multiple of the gauge spacing between the needles.

18. The tufting machine of claim 14, further comprising a backing support over which the backing is moved.

19. The tufting machine of claim 14, wherein the one or more shift mechanisms comprise at least one shift mechanism coupled to the at least one needle bar and configured to control shifting of the at least one needle bar, and at least one shift mechanism coupled to the at least one gauge bar and configured to control the shifting of the at least one gauge bar independently of the shifting of the at least one needle bar.

20. The tufting machine of claim 14, wherein the gauge parts are arranged along the at least one gauge bar at a spacing that is substantially equal to the gauge spacing of the needles along the at least one needle bar.

* * * * *